US009811014B2

(12) United States Patent
Mori et al.

(10) Patent No.: US 9,811,014 B2
(45) Date of Patent: Nov. 7, 2017

(54) YELLOW TONER AND PRODUCTION METHOD THEREFOR

(71) Applicant: CANON KABUSHIKI KAISHA, Tokyo (JP)

(72) Inventors: Shosei Mori, Hiratsuka (JP); Takeshi Sekiguchi, Kawasaki (JP); Taichi Shintou, Saitama (JP); Takeshi Miyazaki, Ebina (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/850,003

(22) Filed: Sep. 10, 2015

(65) Prior Publication Data

US 2015/0378273 A1 Dec. 31, 2015

Related U.S. Application Data

(63) Continuation of application No. PCT/JP2015/001563, filed on Mar. 20, 2015.

(30) Foreign Application Priority Data

Mar. 24, 2014 (JP) ..... 2014-060338

(51) Int. Cl.
*G03G 9/00* (2006.01)
*G03G 9/09* (2006.01)
*G03G 9/08* (2006.01)

(52) U.S. Cl.
CPC ..... *G03G 9/091* (2013.01); *G03G 9/0806* (2013.01); *G03G 9/0924* (2013.01)

(58) Field of Classification Search
CPC ..... G03G 9/091; G03G 9/0924; G03G 9/0806
See application file for complete search history.

(56) References Cited

U.S. PATENT DOCUMENTS 5,853,929 A * 12/1998 Campbell ..... G03G 9/0906 430/107.1
7,833,685 B2 11/2010 Tanaka et al.
8,211,606 B2 7/2012 Murai et al.
8,927,185 B2 1/2015 Higashi et al.
9,012,115 B2 4/2015 Ujifusa et al.
9,069,273 B2 6/2015 Mori et al.
9,170,513 B2 10/2015 Mori et al.
2008/0220358 A1* 9/2008 Tanaka ..... C09B 29/0003 430/108.23
2014/0057202 A1 2/2014 Kitao et al.
2015/0037725 A1 2/2015 Mori et al.
2015/0140487 A1 5/2015 Sekiguchi et al.

FOREIGN PATENT DOCUMENTS

JP 7-140716 A 6/1995
JP 11-282208 A 10/1999
JP 2011-257706 A 12/2011
JP 2011-257707 A 12/2011
JP 2014-29520 A 2/2014
WO 2012/039361 A1 3/2012

OTHER PUBLICATIONS

International Search Report dated May 26, 2015 in International Application No. PCT/JP2015/001563.

* cited by examiner

*Primary Examiner* — Thorl Chea
(74) *Attorney, Agent, or Firm* — Fitzpatrick Cella Harper and Scinto

(57) ABSTRACT

Provided is a toner having high coloring power and being excellent in light fastness. Specifically, provided is a yellow toner, including at least: a binder resin; a wax; and a colorant, in which the colorant contains a compound represented by the general formula (1).

(1)

5 Claims, 1 Drawing Sheet

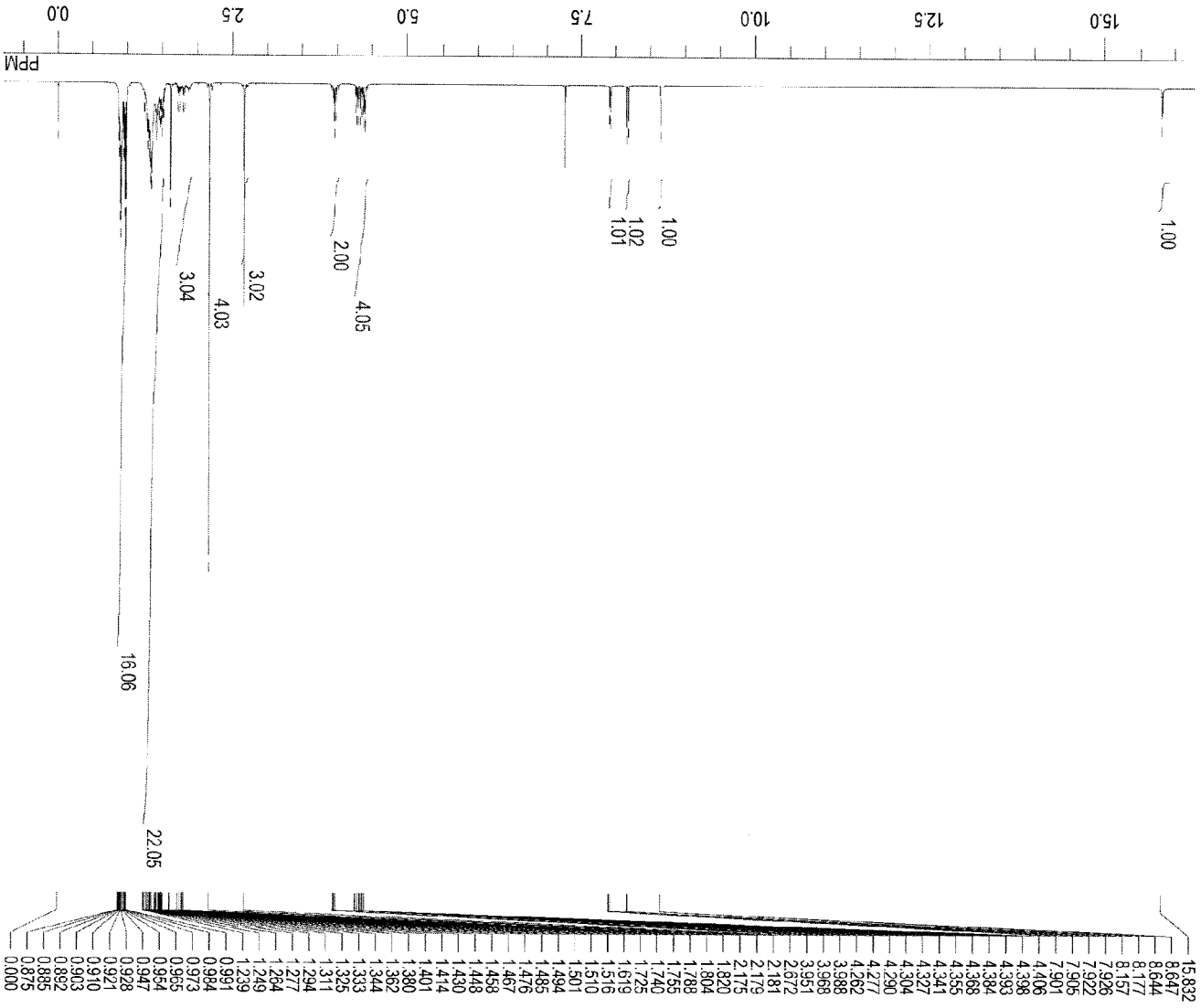
1.00
1.00
1.02
1.01
4.05
2.00
3.02
4.03
3.04
22.05
16.06
15.0
12.5
10.0
7.5
5.0
2.5
0.0
PPM
15.832
8.647
8.644
8.177
8.157
7.926
7.922
7.905
7.901
4.406
4.398
4.393
4.384
4.368
4.355
4.341
4.327
4.304
4.290
4.277
4.262
3.988
3.968
3.951
2.672
2.181
2.179
2.175
1.820
1.804
1.788
1.755
1.740
1.725
1.619
1.516
1.510
1.501
1.494
1.485
1.476
1.467
1.458
1.448
1.430
1.414
1.401
1.380
1.362
1.344
1.333
1.325
1.311
1.294
1.277
1.264
1.249
1.239
0.991
0.984
0.973
0.965
0.954
0.947
0.928
0.921
0.910
0.903
0.892
0.885
0.875
0.000

YELLOW TONER AND PRODUCTION METHOD THEREFOR

CROSS-REFERENCE TO RELATED APPLICATIONS

This application is a continuation of International Application No. PCT/JP2015/001563, filed Mar. 20, 2015, which claims the benefit of Japanese Patent Application No. 2014-060338, filed Mar. 24, 2014.

BACKGROUND OF THE INVENTION

Field of the Invention

The present invention relates to a yellow toner to be used in a recording method such as an electrophotographic method, an electrostatic recording method, a magnetic recording method, or a toner jet method, and to a production method therefor.

Description of the Related Art

In recent years, there has been an increasing demand for an improvement in image quality along with increasing popularity of a color image. In a digital full color copying machine or printer, a color original image is subjected to color separation with filters for blue, green, and red colors, and latent images corresponding to the original image are then developed with developers for yellow, magenta, cyan, and black colors. Therefore, coloring power of colorant in the developer for each color has a large influence on image quality.

It is important to reproduce Japan Color in the printing industry or approximate Adobe RGB used in an RGB workflow. In order to secure such color space, it is effective to use a dyestuff having a wide color gamut.

As typical examples of a yellow colorant for toner, there are known compounds each having, for example, an isoindolinone, quinophthalone, isoindoline, anthraquinone, or azo skeleton. Of those, as a yellow dyestuff, there are known some examples each using a pyridone azo skeleton such as C.I. Solvent Yellow 162, which has high transparency and coloring power and is excellent in light fastness (see Japanese Patent Application Laid-Open No. H07-140716 and Japanese Patent Application Laid-Open No. H11-282208).

In addition, a pyridone azo compound having a phenyl group that is disubstituted or more highly substituted is known to be used for a color filter (see International Publication No. WO2012/039361).

SUMMARY OF THE INVENTION

There is a demand for a yellow toner having further improved high coloring power and light fastness.

The present invention is directed to providing a toner having high coloring power and being excellent in light fastness.

The above-mentioned problem can be solved by the following invention. That is, according to one aspect of the present invention, there is provided a yellow toner, including at least: a binder resin; a wax; and a colorant, in which the colorant contains a compound represented by the general formula (1).

General formula (1)

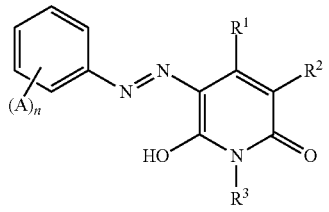

(In the general formula (1): $R^1$ represents an alkyl group, an aryl group, or an amino group; $R^2$ represents a hydrogen atom, a cyano group, a carbamoyl group, an alkoxycarbonyl group, or a carboxamide group; $R^3$ represents a hydrogen atom, an alkyl group, or an acyl group; A represents an alkoxycarbonyl group, an alkoxysulfonyl group, a carboxamide group, or a sulfonamide group; and n represents an integer of from 2 to 5, and n pieces of A may be identical to or different from each other.)

According to the present invention, it is possible to provide the toner having high coloring power and being excellent in light fastness.

Further features of the present invention will become apparent from the following description of exemplary embodiments with reference to the attached drawing.

BRIEF DESCRIPTION OF THE DRAWINGS

FIG. 1 is a $^1$H-NMR spectrum of a compound (1).

DESCRIPTION OF THE EMBODIMENTS

Preferred Embodiments of the Present Invention will now be described in detail in accordance with the accompanying drawing.

Now, the present invention is described by way of embodiments of the present invention.

The inventors of the present invention have made extensive investigations in order to solve the problems of the related art described above, and as a result, have found that a toner having high coloring power and being excellent in light fastness is obtained when a yellow toner includes a toner particle containing a binder resin, a wax, and a colorant, in which the colorant is a compound represented by the following general formula (1). Thus, the inventors have attained the present invention.

General formula (1)

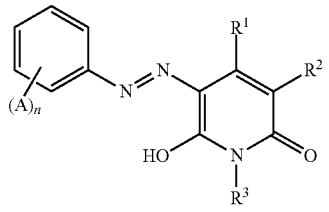

(In the general formula (1): $R^1$ represents an alkyl group, an aryl group, or an amino group; $R^2$ represents a hydrogen atom, a cyano group, a carbamoyl group, an alkoxycarbonyl group, or a carboxamide group; $R^3$ represents a hydrogen atom, an alkyl group, or an acyl group; A represents an alkoxycarbonyl group, an alkoxysulfonyl group, a carboxamide group, or a sulfonamide group; and n represents an integer of from 2 to 5, and n pieces of A may be identical to or different from each other.)

In order to achieve a colorant for toner having high coloring power and being excellent light fastness, matters described below are important. For the coloring power (high coloring property), characteristics inherent to a material based on its structure and substituent effect are important. In addition, the toner contains at least a binder resin, a wax component, and the like, and hence compatibility between the dyestuff (colorant) and the coexisting binder resin or wax component is also important. In particular, in the toner, when the compatibility between the dyestuff and the coexisting binder resin or wax component is poor, association or aggregation occurs to lower the coloring power. Therefore, in order to suppress the association or aggregation responsible for the lowering of the coloring power, the compatibility with each of the binder resin and the wax component needs to be high.

In addition, among the colorant, the binder resin, and the wax component, the compatibility between the dyestuff and the wax component is poor as compared to the compatibility between the dyestuff and the binder resin, and hence an increase in content of the wax component causes the association or aggregation of the colorant, to thereby lower the coloring power. Therefore, it is necessary to solve this problem as well.

In addition, the coloring matter compound represented by the general formula (1) according to the present invention is at least disubstituted (two or more A's are present in the formula (1)), and hence is excellent in light fastness as compared to a monosubstituted compound (one A is present in the formula (1)). This is presumably due to the influence of the state of the electron density of the diazo group moiety of the pyridone azo skeleton. In the present invention, in particular, it is presumed that the use of two electron withdrawing groups as A's in the formula (1) can lower the electron density of the diazo group to improve the light fastness.

[Coloring Matter Compound]

First, the compound represented by the general formula (1) to be used as a coloring matter compound (colorant) is described.

The alkyl group represented by $R^1$ in the general formula (1) is not particularly limited and examples thereof include a methyl group, an ethyl group, a n-propyl group, an iso-propyl group, a n-butyl group, a sec-butyl group, an iso-butyl group, and a tert-butyl group.

The aryl group represented by $R^1$ in the general formula (1) is not particularly limited and an example thereof is a phenyl group.

The amino group represented by $R^1$ in the general formula (1) is not particularly limited and examples thereof include an amino group and a dimethylamino group.

From the viewpoint of excellence in light fastness, $R^1$ in the general formula (1) preferably represents an alkyl group, more preferably a methyl group.

The alkoxycarbonyl group represented by $R^2$ in the general formula (1) is not particularly limited and examples thereof include a methoxycarbonyl group, an ethoxycarbonyl group, a butoxycarbonyl group, and an ethylhexoxycarbonyl group.

Examples of the carboxamide group represented by $R^2$ in the general formula (1) include: carboxy dialkylamide groups such as a carboxydimethylamide group, a carboxy diethylamide group, a carboxy ethyl(2-ethylhexyl)amide group, and a carboxy butyl(ethyl)amide group; and carboxy monoalkylamide groups such as a carboxy methylamide group, a carboxy ethylamide group, and a carboxy 2-ethylhexylamide group.

From the viewpoint of excellence in light fastness, $R^2$ in the general formula (1) preferably represents a cyano group.

The alkyl group represented by $R^3$ in the general formula (1) is not particularly limited and examples thereof include saturated or unsaturated linear, branched, or cyclic primary to tertiary alkyl groups having 1 to 20 atoms such as a methyl group, an ethyl group, a n-propyl group, an iso-propyl group, a n-butyl group, a sec-butyl group, an iso-butyl group, a tert-butyl group, an octyl group, a dodecyl group, a nonadecyl group, a cyclobutyl group, a cyclopentyl group, a cyclohexyl group, a methylcyclohexyl group, a 2-ethylpropyl group, a 2-ethylhexyl group, and an ethyl group substituted with a cyclohexenyl group.

The acyl group represented by $R^3$ in the general formula (1) is not particularly limited and examples thereof include a formyl group, an acetyl group, an ethylhexanoyl group, and a benzoyl group.

From the viewpoint of excellence in light fastness, $R^3$ in the general formula (1) preferably represents an ethyl group, a n-butyl group, or a 2-ethylhexyl group.

The alkoxycarbonyl group represented by A in the general formula (1) is not particularly limited and examples thereof include a methoxycarbonyl group, an ethoxycarbonyl group, a butoxycarbonyl group, a hexoxycarbonyl group, and a 2-ethylhexoxycarbonyl group. In particular, from the viewpoints of excellence in solubility and light fastness, a 2-ethylhexoxycarbonyl group is preferred.

The carboxamide group represented by A in the general formula (1) is not particularly limited and examples thereof include: carboxy dialkylamide groups such as a carboxy dimethylamide group, a carboxy diethylamide group, a carboxy butyl(ethyl)amide group, a carboxy di(ethylhexyl) amide group, and a carboxy di(2-ethylhexyl)amide group; and carboxy monoalkylamide groups such as a carboxy methylamide group, a carboxy ethylamide group, a carboxy (ethylhexyl)amide group, and a carboxy(2-ethylhexyl)amide group. In particular, from the viewpoints of excellence in solubility and light fastness, a carboxy di(2-ethylhexyl) amide group is preferred.

The alkoxysulfonyl group represented by A in the general formula (1) is not particularly limited and examples thereof include a methoxysulfonyl group, an ethoxysulfonyl group, a butoxysulfonyl group, a hexoxysulfonyl group, and a 2-ethylhexoxysulfonyl group. In particular, from the viewpoints of excellence in solubility and light fastness, a 2-ethylhexoxysulfonyl group is preferred.

The sulfonamide group represented by A in the general formula (1) is not particularly limited and examples thereof include: sulfon dialkylamide groups such as a sulfon dimethylamide group, a sulfon diethylamide group, a sulfon butyl(ethyl)amide group, and a sulfon di(2-ethylhexyl) amide group; and sulfon monoalkylamide groups such as a sulfon (2-ethylhexyl)amide group. In particular, from the viewpoints of excellence in solubility and light fastness, a sulfon di(2-ethylhexyl)amide group is preferred.

The compound represented by the general formula (1) to be used in the present invention may be synthesized with reference to a known method disclosed in International Publication No. WO2012/039361.

As preferred examples of the compound represented by the general formula (1), compounds (1) to (30) are shown below. However, the compound represented by the general formula (1) to be used in the present invention is not particularly limited to the following compounds.

In addition, the compound represented by the general formula (1) is shown as an azo form. However, the compound represented by the general formula (1) has azo-hydrazo tautomers, and the hydrazo form also falls within the scope of the present invention.
Compound (1)
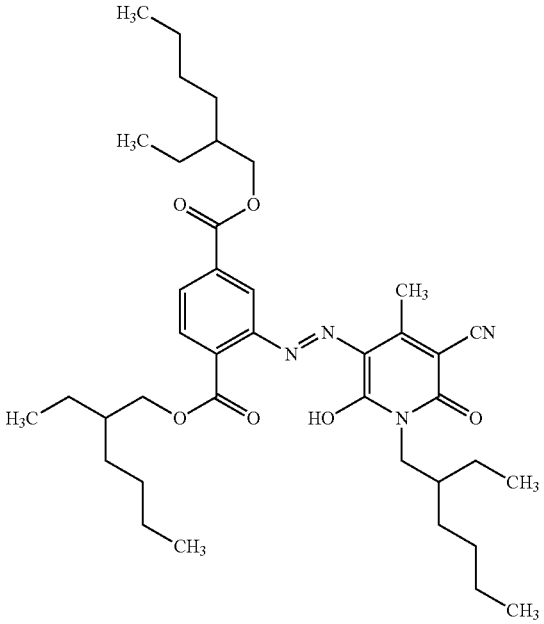
Compound (2)
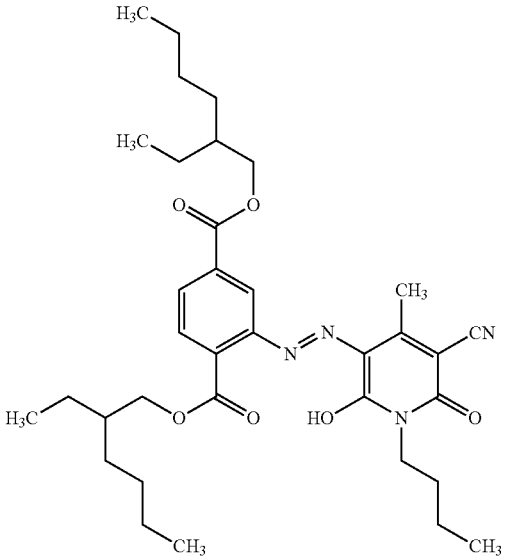
-continued
Compound (3)
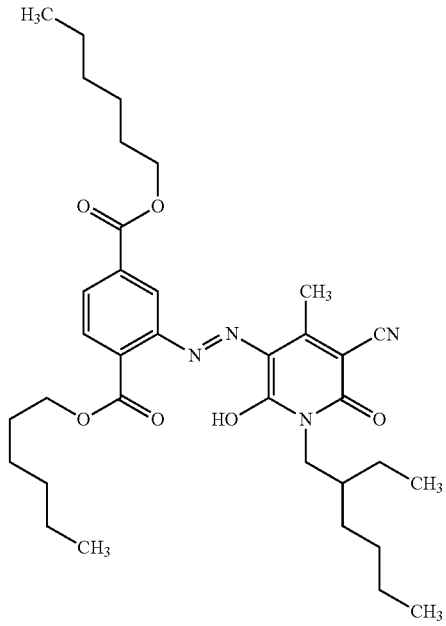
Compound (4)
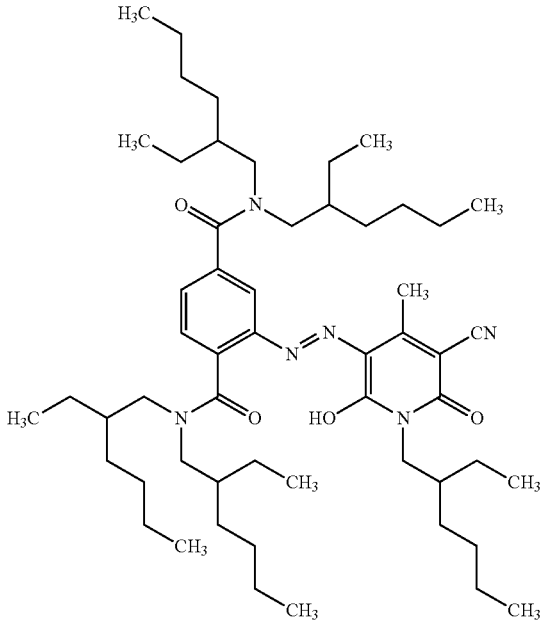

-continued
Compound (5)
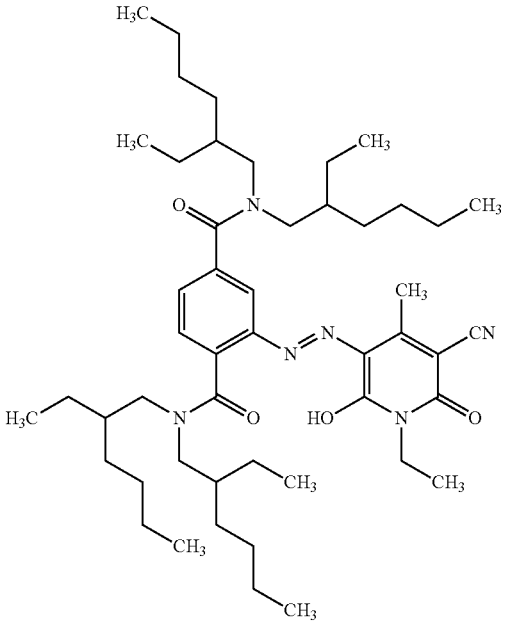
Compound (6)
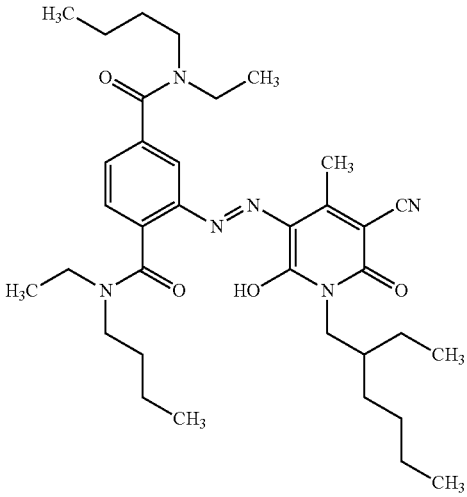
-continued
Compound (7)
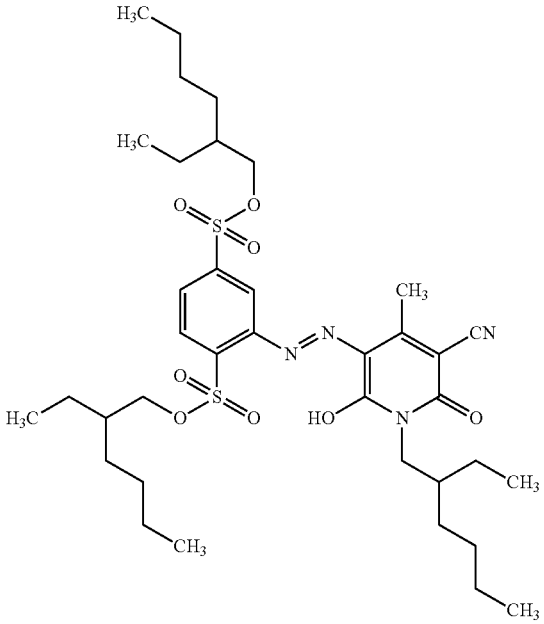
Compound (8)
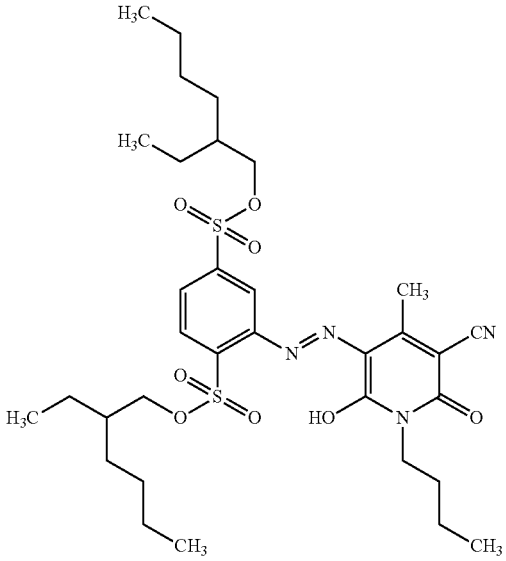

-continued
Compound (9)
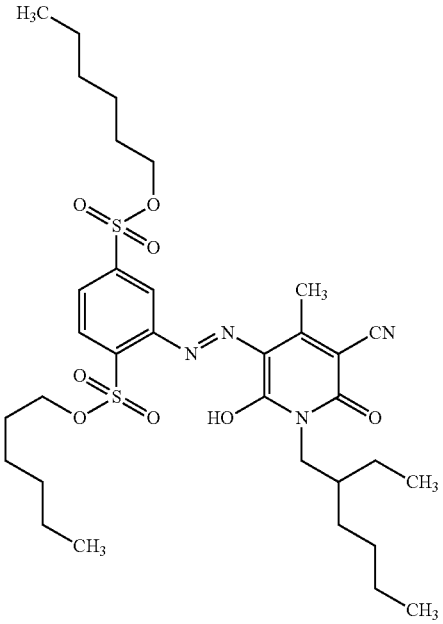
-continued
Compound (11)
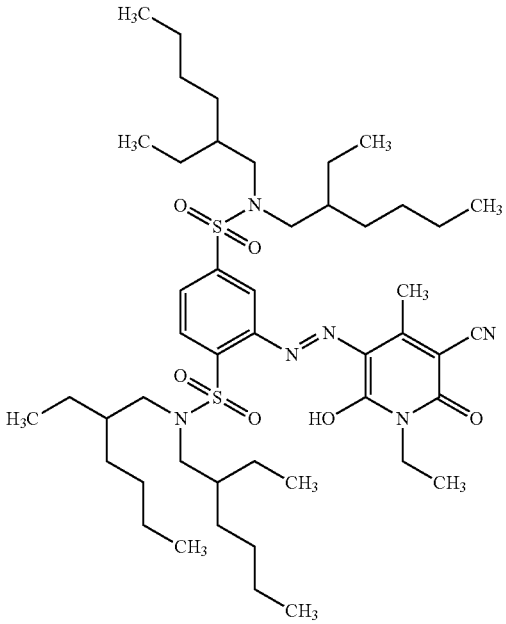
Compound (10)
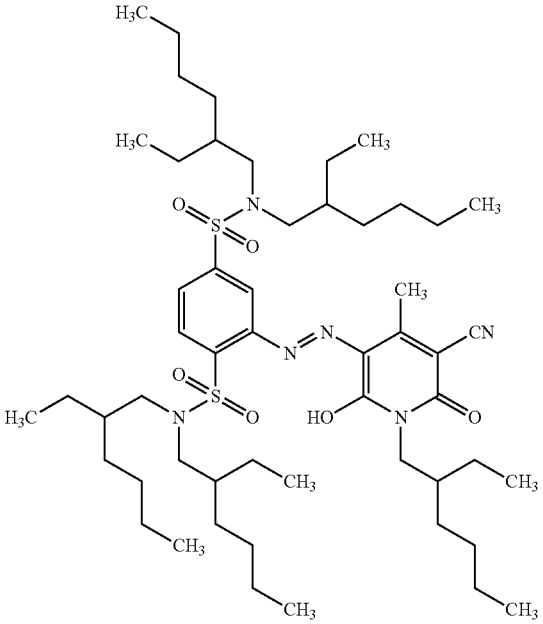
Compound (12)
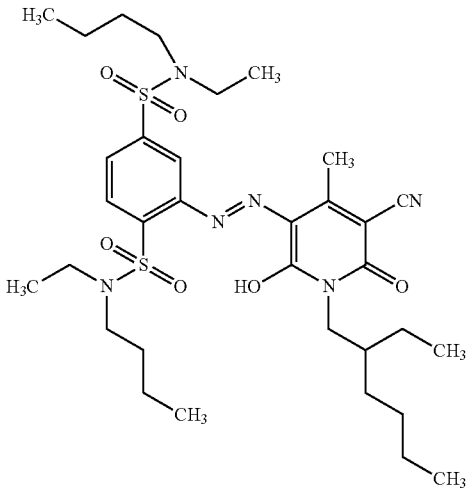

-continued
Compound (13)
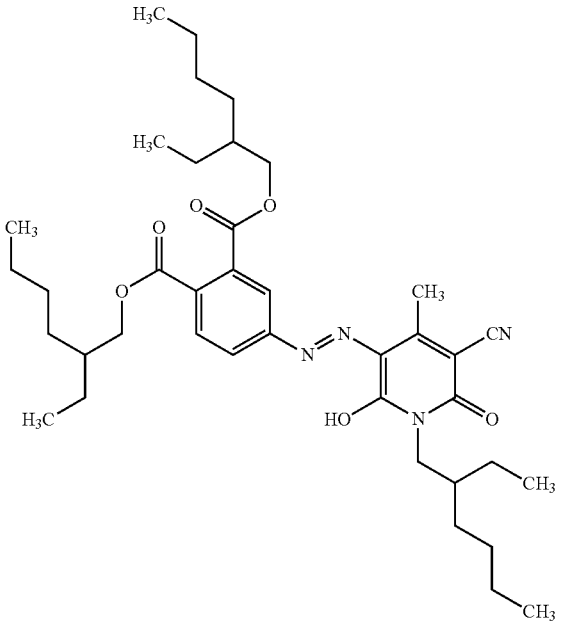
-continued
Compound (15)
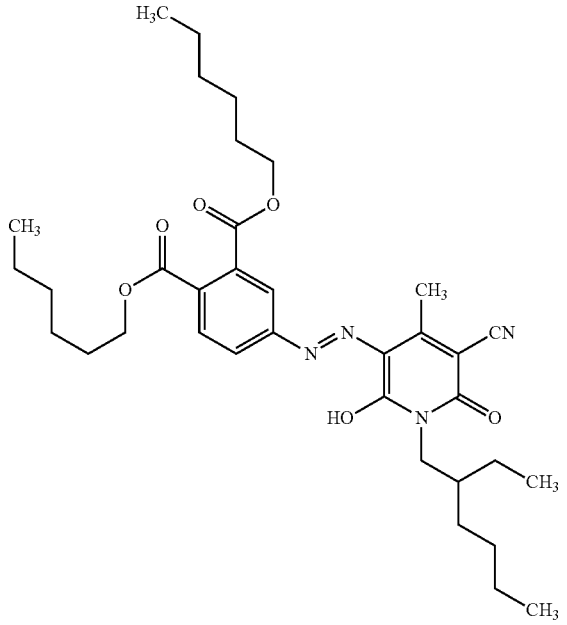
Compound (14)
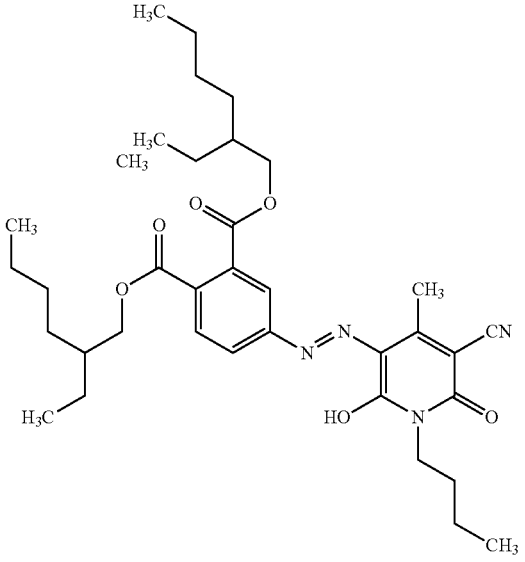
Compound (16)
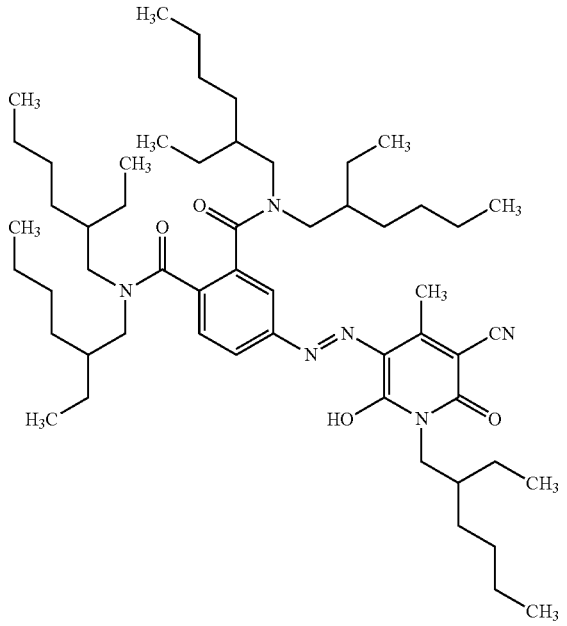

-continued
Compound (17)
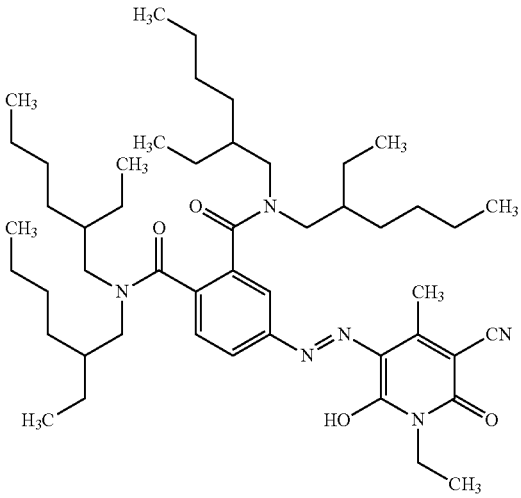
Compound (18)
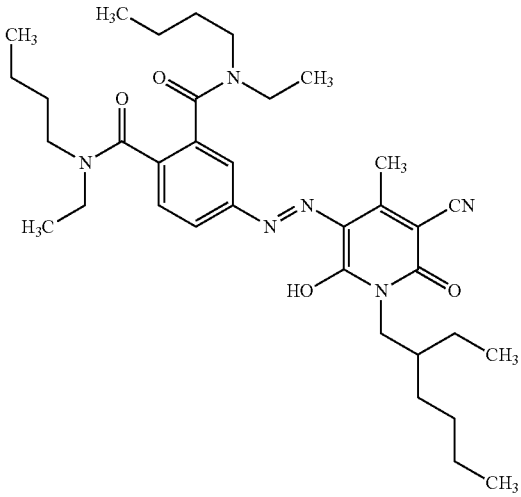
Compound (19)
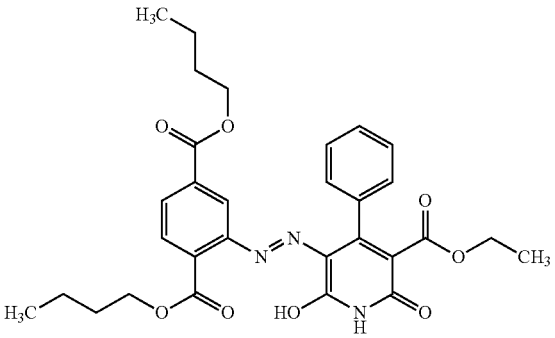
-continued
Compound (20)
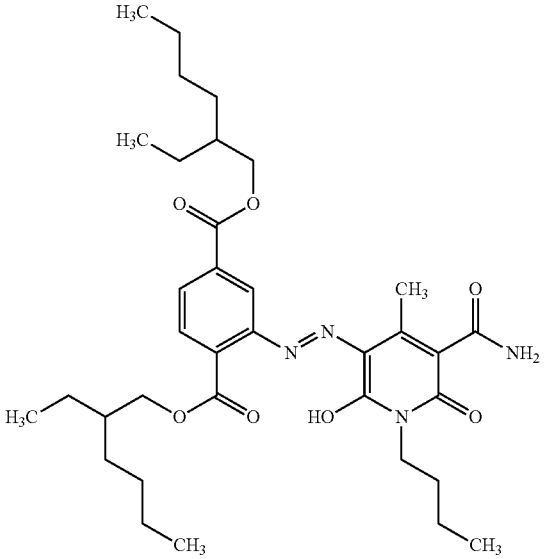
Compound (21)
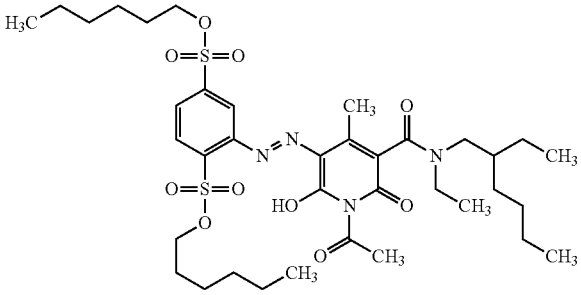
Compound (22)
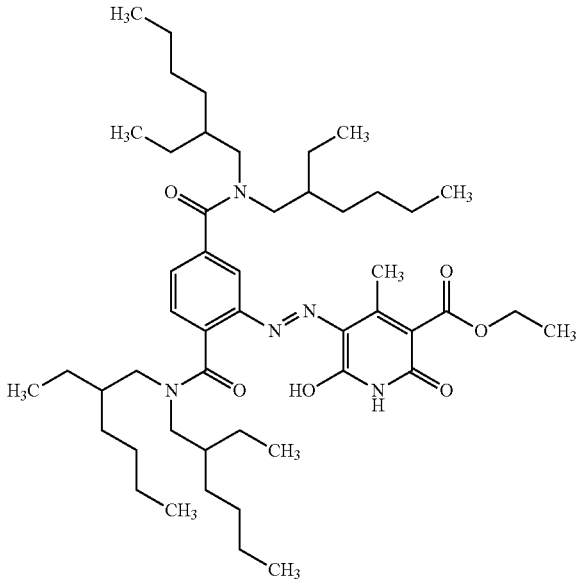

-continued
Compound (23)
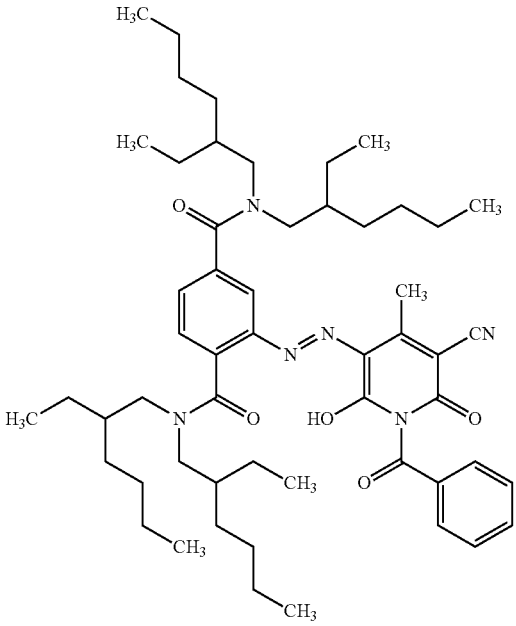
Compound (24)
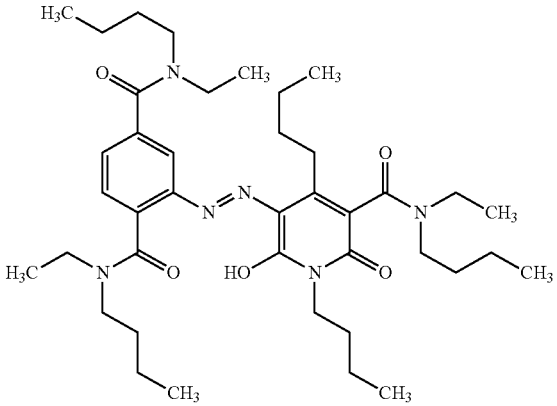
Compound (25)
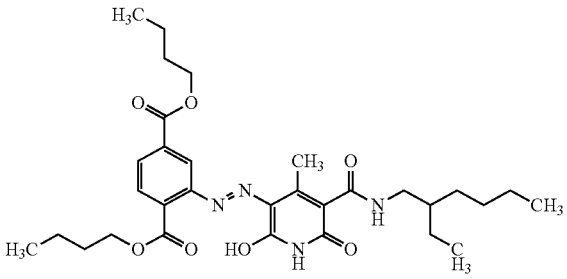
-continued
Compound (26)
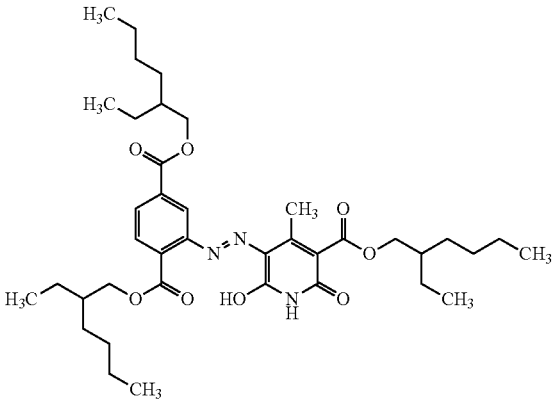
Compound (27)
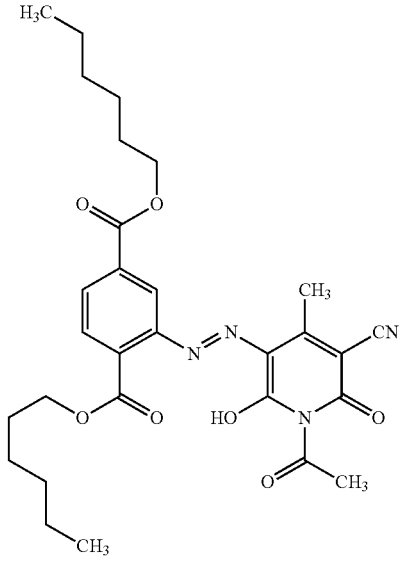
Compound (28)
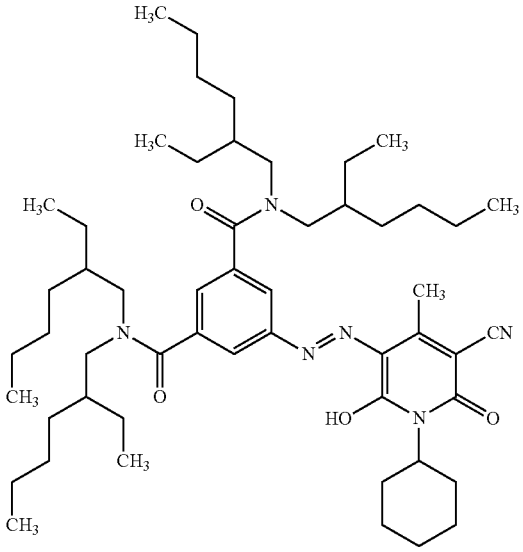

-continued

Compound (29)

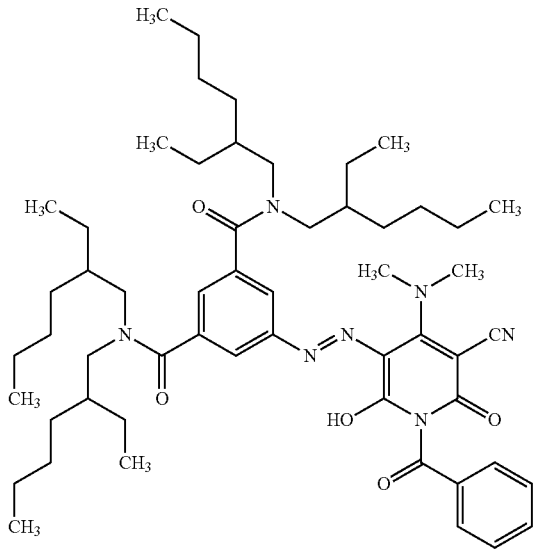

Compound (30)

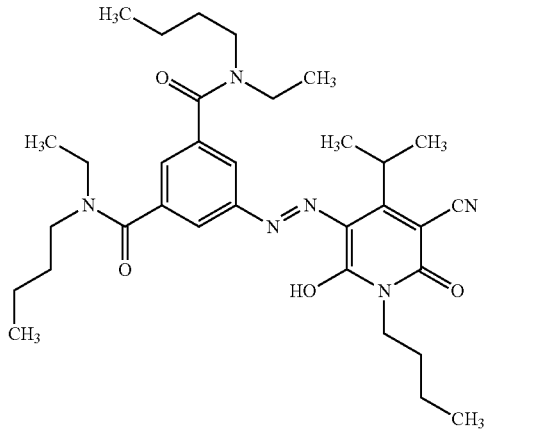

[With Regard to Toner]

The content of the compound represented by the general formula (1) is preferably from 1 part by mass to 20 parts by mass with respect to 100 parts by mass of the binder resin.

In addition, the compound represented by the general formula (1) may be used alone, or may be used in combination with a known yellow dyestuff, so as to adjust a color tone.

In addition, the compound represented by the general formula (1) may also be used in combination with a general yellow pigment. In particular, combined use with C.I. Pigment Yellow 185, C.I. Pigment Yellow 180, or C.I. Pigment Yellow 155 is effective for obtaining a satisfactory yellow color. Those pigments may each be used alone, or may be used as a mixture of two or more kinds thereof.

<Coloring Matter Dispersion>

The production of the yellow toner of the present invention may involve the formation of a coloring matter dispersion having the colorant dispersed in a dispersion medium.

The coloring matter dispersion is obtained by subjecting the compound represented by the general formula (1) to dispersion treatment in a dispersion medium that is an organic solvent or is a mixture of an organic solvent and water. As a method of preparing the coloring matter dispersion, specifically, the following method is given. The compound represented by the general formula (1), and as necessary, a resin are dissolved in the dispersion medium and allowed to sufficiently blend in the dispersion medium with stirring. Further, through the application of a mechanical shear force with a dispersing machine such as a ball mill, a paint shaker, a dissolver, an attritor, a sand mill, or a high-speed mill, the compound may be finely dispersed into a uniform fine particle shape.

In the present invention, the content of the compound represented by the general formula (1) in the coloring matter dispersion is preferably from 1.0 part by mass to 30.0 parts by mass, more preferably from 2.0 parts by mass to 20.0 parts by mass, particularly preferably from 3.0 parts by mass to 15.0 parts by mass with respect to 100 parts by mass of the dispersion medium. When the content of the compound represented by the general formula (1) falls within the above-mentioned range, an increase in viscosity as the coloring matter dispersion can be suppressed, and besides, the dispersibility of the compound represented by the general formula (1) in the dispersion medium can be further improved to exhibit satisfactory coloring power.

Examples of the organic solvent to be used as the dispersion medium include: alcohols such as methyl alcohol, ethyl alcohol, denatured ethyl alcohol, isopropyl alcohol, n-butyl alcohol, isobutyl alcohol, tert-butyl alcohol, sec-butyl alcohol, tert-amyl alcohol, 3-pentanol, octyl alcohol, benzyl alcohol, and cyclohexanol; glycols such as methyl cellosolve, ethyl cellosolve, diethylene glycol, and diethylene glycol monobutyl ether; ketones such as acetone, methyl ethyl ketone, and methyl isobutyl ketone; esters such as ethyl acetate, butyl acetate, ethyl propionate, and cellosolve acetate; hydrocarbon-based solvents such as hexane, octane, petroleum ether, cyclohexane, benzene, toluene, and xylene; halogenated hydrocarbon-based solvents such as carbon tetrachloride, trichloroethylene, and tetrabromoethane; ethers such as diethyl ether, dimethyl glycol, trioxane, and tetrahydrofuran; acetals such as methylal and diethyl acetal; organic acids such as formic acid, acetic acid, and propionic acid; and heteroelement (such as sulfur or nitrogen)-containing organic compounds such as nitrobenzene, dimethylamine, monoethanolamine, pyridine, dimethyl sulfoxide, and dimethylformamide.

In addition, when the toner particle is produced by a suspension polymerization method, a polymerizable monomer is preferably used as the organic solvent to be used as the dispersion medium. The polymerizable monomer is preferably an addition-polymerizable monomer. Specific examples thereof may include: styrene-based monomers such as styrene, o-methylstyrene, m-methylstyrene, p-methylstyrene, o-ethylstyrene, m-ethylstyrene, and p-ethylstyrene; acrylate-based monomers such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, diethylaminoethyl acrylate, acrylonitrile, and acrylamide; methacrylate-based monomers such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, diethylaminoethyl methacrylate, methacrylonitrile, and methacrylamide; olefin-based monomers such as ethylene, propylene, butylene, butadiene, isoprene, isobutylene, and cyclohexene; vinyl halides such as vinyl chloride, vinylidene chloride, vinyl bromide, and vinyl iodide; vinyl esters such as vinyl acetate, vinyl propionate, and vinyl benzoate; vinyl ethers such as vinyl methyl ether, vinyl ethyl ether, and vinyl isobutyl ether; and vinyl ketone compounds such as vinyl methyl ketone, vinyl hexyl ketone, and methyl isopropenyl ketone. Those polymerizable monomers may each be used alone, or may be used in combination of two or more kinds thereof, depending on intended use. In particular, of the above-mentioned polymerizable monomers, styrene, an acrylate-based monomer, or a methacrylate-based monomer is preferred, and these monomers are preferably used each alone or in combination. Particularly from the viewpoint of ease of handling, styrene is preferred as the dispersion medium.

As described above, a resin may be added to the coloring matter dispersion. The resin to be contained in the coloring matter dispersion is determined depending on intended use and is not particularly limited. When the toner is produced by a dissolution suspension method, it is appropriate to dissolve a resin to be used as the binder resin. Specific examples of the resin to be used as the binder resin include a polystyrene resin, a polyacrylic acid resin, a polymethacrylic acid resin, a polyacrylate resin, a polymethacrylate resin, styrene-acrylic copolymers (such as a styrene-acrylic acid ester copolymer, a styrene-methacrylic acid ester copolymer, and a styrene-acrylic acid ester-methacrylic acid ester copolymer), a polyester resin, a polyvinyl ether resin, a polyvinyl methyl ether resin, a polyvinyl alcohol resin, and a polyvinyl butyral resin. Those resins may each be used alone, or may be used as a mixture of two or more kinds thereof.

The coloring matter dispersion may be dispersed in water with an emulsifier. For example, when the coloring matter dispersion containing a resin is dispersed in water, the toner may be produced by a dissolution suspension method. Examples of the emulsifier to be used in this case include a cationic surfactant, an anionic surfactant, and a nonionic surfactant. Examples of the cationic surfactant include dodecylammonium chloride, dodecylammonium bromide, dodecyltrimethylammonium bromide, dodecylpyridinium chloride, dodecylpyridinium bromide, and hexadecyltrimethylammonium bromide. Examples of the anionic surfactant include fatty acid soap of sodium stearate or sodium dodecanoate, sodium dodecyl sulfate, sodium dodecylbenzenesulfonate, and sodium lauryl sulfate. Examples of the nonionic surfactant include dodecyl polyoxyethylene ether, hexadecyl polyoxyethylene ether, nonylphenyl polyoxyethylene ether, lauryl polyoxyethylene ether, sorbitan monooleate polyoxyethylene ether, and monodecanoyl sucrose.

<Binder Resin>

The binder resin to be used for the yellow toner of the present invention is not particularly limited and an example thereof may be a thermoplastic resin.

Specific examples thereof include vinyl-based resins that are homopolymers or copolymers of polymerizable monomers described below. Specific examples of the polymerizable monomers may include: styrene and styrene derivatives such as styrene, p-chlorostyrene, and α-methylstyrene; acrylic acid esters such as methyl acrylate, ethyl acrylate, n-propyl acrylate, n-butyl acrylate, lauryl acrylate, and 2-ethylhexyl acrylate; methacrylic acid esters such as methyl methacrylate, ethyl methacrylate, n-propyl methacrylate, lauryl methacrylate, and 2-ethylhexyl methacrylate; vinylnitriles such as acrylonitrile and methacrylonitrile; vinyl ethers such as vinyl ethyl ether and vinyl isobutyl ether; ketones such as vinyl methyl ketone, vinyl ethyl ketone, and vinyl isopropenyl ketone; and olefins such as ethylene, propylene, butadiene, and isoprene. It should be noted that the resin to be used as the binder resin is not limited to the vinyl-based resins. Non-vinyl condensed resins such as an epoxy resin, a polyester resin, a polyurethane resin, a polyamide resin, a cellulose resin, and a polyether resin may also be used as the resin other than the vinyl-based resins. In addition, a graft polymer of any one of those non-vinyl condensed resins and a vinyl-based monomer may also be used. One kind of those resins may be used alone, or two or more kinds thereof may be used in combination.

In addition, the polyester resin is a resin synthesized from a di- or higher valent acid component and a di- or higher hydric alcohol component.

In the present invention, the acid component is not particularly limited and examples thereof include an aliphatic dicarboxylic acid, a dicarboxylic acid having a double bond, and a dicarboxylic acid having a sulfonic acid group. Specific examples thereof include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, and lower alkyl esters or acid anhydrides thereof. In particular, an aliphatic dicarboxylic acid is preferred, and an aliphatic dicarboxylic acid in which an aliphatic moiety is a saturated hydrocarbon, i.e., a saturated carboxylic acid is more preferred.

The alcohol component is not particularly limited, but is preferably an aliphatic diol. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol.

The polyester resin is not particularly limited, but is particularly preferably one having a molar ratio "alcohol component/acid component" in all components of from 45/55 to 55/45.

In addition, as the number of terminal groups of a molecular chain of the polyester resin increases, the charging characteristics of the toner are liable to become more environmentally dependent. Accordingly, the polyester resin has an acid value of preferably 90 mg KOH/g or less, more preferably 50 mg KOH/g or less. In addition, the polyester resin has a hydroxyl value of preferably 50 mg KOH/g or less, more preferably 30 mg KOH/g or less. It should be noted that the hydroxyl value is preferably 3 mg KOH/g or more in consideration of the triboelectric charging characteristics of the toner.

In the present invention, a crosslinking agent may be used at the time of the synthesis of the binder resin for improving the mechanical strength of the toner, and at the same time, for controlling the molecular weight of a toner molecule.

The crosslinking agent to be used in the toner of the present invention is not particularly limited. Specifically, a bifunctional crosslinking agent or a polyfunctional crosslinking agent may be used as the crosslinking agent. Examples of the bifunctional crosslinking agent include divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycols #200, #400, and #600, dipropylene glycol diacrylate, polypropylene glycol diacrylate, polyester-type diacrylates, and ones obtained by changing the diacrylates to dimethacrylates.

The polyfunctional crosslinking agent is not particularly limited and examples thereof include pentaerythritol triacrylate, trimethylolethane triacrylate, trimethylolpropane triacrylate, tetramethylolmethane tetraacrylate, oligoester acrylate and methacrylate thereof, 2,2-bis(4-mathacryloxyphenyl)propane, diallyl phthalate, triallyl cyanurate, triallyl isocyanurate, and triallyl trimellitate.

Any such crosslinking agent is used in an amount of preferably from 0.05 part by mass to 10 parts by mass, more preferably from 0.1 part by mass to 5 parts by mass, with respect to 100 parts by mass of the polymerizable monomer to be used for obtaining the binder resin.

The binder resin has a glass transition temperature of preferably from 45° C. to 80° C., more preferably from 55° C. to 70° C. In addition, the binder resin preferably has a number-average molecular weight (Mn) of from 2,500 to 50,000. In addition, the binder resin preferably has a weight-average molecular weight (Mw) of from 10,000 to 1,000,000.

<Wax>

The wax to be used as a constituent material for the toner in the present invention is not particularly limited and examples thereof include: a petroleum-based wax such as paraffin wax, microcrystalline wax, or petrolatum and a derivative thereof; montan wax and a derivative thereof; a hydrocarbon wax obtained by a Fischer-Tropsch method and a derivative thereof; a polyolefin wax typified by polyethylene and a derivative thereof; and a natural wax such as carnauba wax or candelilla wax and a derivative thereof. It should be noted that the derivative includes an oxide, a block copolymerized product with a vinyl monomer, and a graft modified product. In addition, examples thereof include an alcohol such as a higher aliphatic alcohol, aliphatics such as stearic acid and palmitic acid or compounds thereof, an acid amide, an ester, a ketone, a hydrogenated castor oil and a derivative thereof, a vegetable wax, and an animal wax. Those waxes may each be used alone, or may be used in combination.

The addition amount of the wax falls within the range of preferably from 2.5 parts by mass to 15.0 parts by mass, more preferably from 3.0 parts by mass to 10.0 parts by mass with respect to 100 parts by mass of the binder resin. When the addition amount of the wax is adjusted to fall within the above-mentioned range, oilless fixation can be facilitated, and besides, influences on the charging characteristics can be suppressed to lower levels.

The wax to be used in the present invention is preferably one having a melting point of 50° C. or more and 200° C. or less, more preferably one having a melting point of 55° C. or more and 150° C. or less. It should be noted that when the melting point of the wax is 50° C. or more and 200° C. or less, the blocking resistance of the toner is further improved, and moreover, exudation of the wax at the time of fixation can be improved to improve releasability in oilless fixation.

It should be noted that the melting point in the present invention refers to a peak temperature of the maximum endothermic peak in a differential scanning calorimetry (DSC) curve measured in conformity with ASTM D3418-82. Specifically, a DSC curve within the temperature range of from 30 to 200° C. is obtained by the second temperature increasing method under a normal-temperature and normal-humidity environment through the use of a differential scanning calorimeter (manufactured by Mettler Toledo International Inc.: DSC822) within the measurement temperature range of from 30° C. to 200° C. at a rate of temperature increase of 5° C./min, and the melting point of the wax is a peak temperature of the maximum endothermic peak in the resultant DSC curve.

<Other Toner Constituent Materials>

The toner of the present invention may contain a charge control agent as necessary. This can facilitate optimal triboelectric charge amount control in accordance with a development system.

As the charge control agent, a known one may be utilized, and a charge control agent that has a high charging speed and can stably maintain a certain charging amount is particularly preferred. Further, when the toner is manufactured by a direct polymerization method, a charge control agent that has a low polymerization inhibition property and is substantially free of any substance soluble in an aqueous dispersion medium is particularly preferred.

The charge control agent is exemplified by charge control agents for controlling the toner so as to have a negative charge, such as a polymer or copolymer having a sulfonic acid group, a sulfonic acid salt group, or an alkoxysulfonyl group, a salicylic acid derivative and a metal complex thereof, a monoazo metal compound, an acetylacetone metal compound, an aromatic oxycarboxylic acid, aromatic mono- and polycarboxylic acids and metal salts, anhydrides, and esters thereof, phenol derivatives such as bisphenol, a urea derivative, a metal-containing naphthoic acid-based compound, a boron compound, a quaternary ammonium salt, a calixarene, and a resin-based charge control agent.

The charge control agent is also exemplified by charge control agents for controlling the toner so as to have a positive charge, such as: nigrosine and nigrosine-modified products with fatty acid metal salts; guanidine compounds; imidazole compounds; quaternary ammonium salts such as tributylbenzylammonium 1-hydroxy-4-naphthosulfonate and tetrabutylammonium tetrafluoroborate, and analogues thereof including onium salts such as phosphonium salts and lake pigments thereof; triphenylmethane dyestuffs and lake pigments thereof (laking agents include phosphotungstic acid, phosphomolybdic acid, phosphotungstic molybdic acid, tannic acid, lauric acid, gallic acid, ferricyanides, and ferrocyanides); metal salts of higher fatty acids; diorganotin oxides such as dibutyl tin oxide, dioctyl tin oxide, and dicyclohexyl tin oxide; diorganotin borates such as dibutyl tin borate, dioctyl tin borate, and dicyclohexyl tin borate; and a resin-based charge control agent. One kind of those charge control agents may be used alone, or two or more kinds thereof may be used in combination.

An inorganic fine particle or a resin particle may be added as an external additive to a toner particle of the yellow toner of the present invention. Examples of the inorganic fine particles include fine particles of silica, titanium oxide, alumina, or a complex oxide thereof, or a product obtained by treating the surface of any such oxide. Examples of the resin particles include resin particles of a vinyl-based resin, a polyester resin, and a silicone resin. Those inorganic fine particles and resin particles are external additives each functioning as a fluidity aid or a cleaning aid.

[Production Method for Toner Particle]

Production methods for a toner particle are described below, but the present invention is not limited to these production methods.

Examples of the method of producing a toner particle include a pulverization method, a suspension polymerization method, a suspension granulation method, an emulsion polymerization method, an emulsion aggregation method, a dissolution suspension method, and an ester extension polymerization method.

<Production of Toner Particle by Suspension Polymerization Method>

The suspension polymerization method is a production method including the following steps of:

preparing a polymerizable monomer composition containing a colorant, a wax, and a polymerizable monomer;

forming a particle of the polymerizable monomer composition in an aqueous medium; and polymerizing the polymerizable monomer, which is contained in the particle of the polymerizable monomer composition, in the aqueous medium to provide a toner particle.

It should be noted that a polymerization initiator may be incorporated into the polymerizable monomer composition, or may be added before granulation or during granulation.

The polymerizable monomer composition in the production method for a toner particle is preferably one prepared by mixing a dispersion liquid (coloring matter dispersion), which has the colorant dispersed in a first polymerizable monomer, with a second polymerizable monomer. That is, when the colorant is sufficiently dispersed in the first polymerizable monomer before being mixed with the second polymerizable monomer as well as any other toner material, the colorant is allowed to be present in a more satisfactory dispersion state in the toner particle. It should be noted that the first polymerizable monomer and the second polymerizable monomer may be the same polymerizable monomer or may be different polymerizable monomers.

A known polymerization initiator may be used as the polymerization initiator to be used in the suspension polymerization method, and specific examples thereof include an azo compound, an organic peroxide, an inorganic peroxide, an organometallic compound, and a photopolymerization initiator. More specific examples thereof include: azo-based polymerization initiators such as 2,2'-azobis(isobutyronitrile), 2,2'-azobis(2-methylbutyronitrile), 2,2'-azobis(4-methoxy-2,4-dimethylvaleronitrile), 2,2'-azobis(2,4-dimethylvaleronitrile), and dimethyl 2,2'-azobis(isobutyrate); organic peroxide-based polymerization initiators such as benzoyl peroxide, di-tert-butyl peroxide, tert-butylperoxy-isopropyl monocarbonate, tert-hexylperoxy benzoate, and tert-butylperoxy benzoate; inorganic peroxide-based polymerization initiators such as potassium persulfate and ammonium persulfate; and redox initiators such as hydrogen peroxide-ferrous, BPO-dimethylaniline-based, and cerium (IV) salt-alcohol-based redox initiators. Examples of the photopolymerization initiator include acetophenone, benzoin methyl ether, and benzoin methyl ketal. Those polymerization initiators may each be used alone, or may be used in combination of two or more thereof.

The addition amount of the polymerization initiator is preferably from 0.1 part by mass to 20 parts by mass, more preferably from 0.1 part by mass to 10 parts by mass with respect to 100 parts by mass of the polymerizable monomer. The polymerizable initiator, the kind of which slightly varies depending on a polymerization method, is used alone or as a mixture with reference to its 10-hour half-life temperature.

A dispersion stabilizer is preferably incorporated into the aqueous medium to be used in the suspension polymerization method. As the dispersion stabilizer, known inorganic and organic dispersion stabilizers may be used. Examples of the inorganic dispersion stabilizer include calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Examples of the organic dispersion stabilizer include polyvinyl alcohol, gelatin, methylcellulose, methylhydroxypropylcellulose, ethylcellulose, a sodium salt of carboxymethylcellulose, and starch. In addition, nonionic, anionic, and cationic surfactants may also be utilized, and specific examples thereof include sodium dodecyl sulfate, sodium tetradecyl sulfate, sodium pentadecyl sulfate, sodium octyl sulfate, sodium oleate, sodium laurate, potassium stearate, and calcium oleate.

Of the dispersion stabilizers, a poorly water-soluble inorganic dispersion stabilizer that is soluble in an acid is preferably used in the present invention. In addition, in the present invention, when an aqueous dispersion medium is prepared with the poorly water-soluble inorganic dispersion stabilizer, such dispersion stabilizer is preferably used at a ratio in a range of from 0.2 part by mass to 2.0 parts by mass with respect to 100 parts by mass of the polymerizable monomer in terms of the droplet stability of the polymerizable monomer composition in the aqueous medium. In addition, in the present invention, the aqueous medium is preferably prepared with water whose amount ranges from 300 parts by mass to 3,000 parts by mass with respect to 100 parts by mass of the polymerizable monomer composition.

In the present invention, when the aqueous medium in which the hardly water-soluble, inorganic dispersion stabilizer is dispersed is prepared, a commercially available dispersion stabilizer may be directly used and dispersed. It should be noted that it is preferred to produce and prepare the poorly water-soluble inorganic dispersion stabilizer in water under high-speed stirring in order to obtain fine dispersion stabilizer particles having a uniform grain size. For example, when calcium phosphate is used as a dispersion stabilizer, a preferred dispersion stabilizer may be obtained by forming calcium phosphate fine particles through the mixing of an aqueous solution of sodium phosphate and an aqueous solution of calcium chloride under high-speed stirring.

<Production of Toner Particle by Suspension Granulation Method>

The toner particle contained in the toner of the present invention may be particle produced by the suspension granulation method. No heating step is included in the suspension granulation method. Thus, the compatibilization of the resin and the wax that occurs when a low-melting wax is used is suppressed, and a reduction in glass transition temperature of the toner resulting from the compatibilization can be prevented. In addition, the suspension granulation method offers a wide choice of toner materials each serving as the binder resin, and facilitates the use of a polyester resin generally credited with being advantageous for fixability as a main component. Accordingly, the suspension granulation method is a production method advantageous when a toner of such resin composition that the suspension polymerization method is hardly applied is produced.

When the suspension granulation method is used, for example, the toner particle may be produced as described below.

First, the colorant, the binder resin, and the wax are mixed in a solvent to prepare a solvent composition (coloring matter dispersion). Next, the solvent composition is dispersed in a liquid medium and the solvent composition is granulated into a particle to provide a toner particle suspension. Then, the solvent is removed by, for example, heating the thus-obtained suspension or reducing the pressure in the reaction vessel. Thus, the toner particle may be obtained.

The solvent composition is preferably one prepared by dispersing the colorant in a first solvent to provide a dispersion liquid and further mixing the dispersion liquid with a second solvent as well as any other toner material. This allows the pigment to be present in a more satisfactory dispersion state in the toner particle.

Examples of the solvent that may be used in the suspension granulation method include: hydrocarbons such as toluene, xylene, and hexane; halogen-containing hydrocarbons such as methylene chloride, chloroform, dichloroethane, trichloroethane, and carbon tetrachloride; alcohols such as methanol, ethanol, butanol, and isopropyl alcohol; polyhydric alcohols such as ethylene glycol, propylene glycol, diethylene glycol, and triethylene glycol; cellosolves such as methyl cellosolve and ethyl cellosolve; ketones such as acetone, methyl ethyl ketone, and methyl isobutyl ketone; ethers such as benzyl alcohol ethyl ether, benzyl alcohol isopropyl ether, and tetrahydrofuran; and esters such as methyl acetate, ethyl acetate, and butyl acetate. It should be noted that those solvents may be used alone or as a mixture of two or more kinds thereof. Of those, a solvent having a low boiling point and capable of sufficiently dissolving the binder resin is preferably used because the solvent in the toner particle suspension can be easily removed.

The amount of use of the solvent falls within the range of preferably from 50 parts by mass to 5,000 parts by mass, more preferably from 120 parts by mass to 1,000 parts by mass with respect to 100 parts by mass of the binder resin.

A dispersion stabilizer is preferably incorporated into the liquid medium such as the aqueous medium to be used in the suspension granulation method. As the dispersion stabilizer, the ones to be used in the suspension polymerization method may be similarly used. The amount of use of the dispersion stabilizer preferably falls within the range of from 0.01 part by mass to 20 parts by mass with respect to 100 parts by mass of the binder resin from the viewpoint of the droplet stability of the solvent composition in the liquid medium such as the aqueous medium.

<Production of Toner Particle by Pulverization Method>

When the toner particle is produced by the pulverization method, the charge control agent or any other additive is used as necessary in addition to the colorant, the binder resin, and the wax.

In the pulverization method, the toner particle may be produced using known production apparatus such as a mixing machine, a heat kneading machine, and a classifier.

First, the binder resin, the colorant, and the wax, and as necessary, any other material such as the charge control agent are sufficiently mixed using a mixing machine such as a Henschel mixer or a ball mill. Next, the mixture is melted using a heat kneading machine such as a roll, a kneader, or an extruder. Further, the molten mixture is agitated and kneaded to compatibilize the resin and other materials with each other and the wax is dispersed in the resultant. After cooling and solidification, pulverization and classification are performed. Thus, the toner particle may be obtained.

In the pulverization method, one kind of binder resin may be used alone, or two or more kinds of binder resins may be used in combination. When two or more kinds of resins are used as a mixture, it is preferred to mix resins having different molecular weights in order to control the viscoelastic characteristics of the toner.

[Production of Toner Particle by Emulsion Aggregation Method]

Next, a production method for a toner particle by an emulsion aggregation method is described.

The emulsion aggregation method is a production method including the following steps of: preparing a wax dispersion liquid having a wax dispersed in an aqueous medium; preparing a resin particle dispersion liquid having a resin particle dispersed in an aqueous medium; preparing a colorant dispersion liquid having a colorant dispersed in an aqueous medium; aggregating the wax, the resin particle, and the colorant, which are contained in the wax dispersion liquid, the resin particle dispersion liquid, and the colorant dispersion liquid, respectively, by mixing the dispersion liquids with each other, to thereby form an aggregated particle; and fusing the aggregated particle through heating. It should be noted that the aqueous medium means a medium containing water as a main component. Specific examples of the aqueous medium include water itself, water having added thereto a pH adjuster, and water having added thereto an organic solvent.

When the emulsion aggregation method is used, a washing step and a drying step are generally performed after the fusing step.

A dispersant such as a surfactant may be added to the dispersion liquid of each component (wax dispersion liquid, resin particle dispersion liquid, or colorant dispersion liquid). The colorant is dispersed by a known method, and a medium-type dispersing machine such as a rotation shearing-type homogenizer, a ball mill, a sand mill, or an attritor, or a high-pressure counter collision-type dispersing machine is preferably used.

Examples of the surfactant include a water-soluble polymer, an inorganic compound, and an ionic or non-ionic surfactant. In particular, an ionic surfactant having high dispersibility is preferably used from the viewpoint of dispersibility, and an anionic surfactant is particularly preferably used.

Further, the molecular weight of the surfactant is preferably from 100 to 10,000, more preferably from 200 to 5,000, from the viewpoints of a washing property and surface active performance.

Specific examples of the surfactant include: water-soluble polymers such as polyvinyl alcohol, methylcellulose, carboxymethylcellulose, and sodium polyacrylate; surfactants including anionic surfactants such as sodium dodecylbenzenesulfonate, sodium octadecylsulfate, sodium oleate, sodium laurate, and potassium stearate, cationic surfactants such as laurylamine acetate and lauryltrimethylammonium chloride, amphoteric surfactants such as lauryldimethylamine oxide, and nonionic surfactants such as a polyoxyethylene alkyl ether, a polyoxyethylene alkylphenyl ether, and a polyoxyethylene alkylamine; and inorganic compounds such as tricalcium phosphate, aluminum hydroxide, calcium sulfate, calcium carbonate, and barium carbonate.

It should be noted that one kind thereof may be used alone or two or more kinds thereof may be used in combination, as necessary.

(Wax Dispersion Liquid)

The wax dispersion liquid to be used in the emulsion aggregation method is prepared by dispersing a wax in an aqueous medium. The wax dispersion liquid is prepared by a known method. It should be noted that the any of the above-mentioned waxes may be used as the wax.

(Resin Particle Dispersion Liquid)

The resin particle dispersion liquid is prepared by dispersing a resin particle in an aqueous medium.

In the present invention, the aqueous medium means a medium containing water as a main component. Specific examples of the aqueous medium include water itself, water having added thereto a pH adjuster, and water having added thereto an organic solvent.

The resins given as examples of the binder resin may each be used as a resin constituting the resin particle contained in the resin particle dispersion liquid. The resin particle dispersion liquid to be used in the present invention is obtained by dispersing a resin particle in an aqueous medium. The resin particle dispersion liquid is prepared by a known method. For example, in the case of a resin particle dispersion liquid containing a resin particle containing as a constituent element a vinyl-based monomer, particularly a styrene-based monomer, the resin particle dispersion liquid may be prepared by subjecting the monomer to emulsion polymerization with a surfactant or the like.

In addition, in the case of a resin (e.g., a polyester resin) produced by another method, the resin is dispersed in water together with an ionic surfactant and a polymer electrolyte through the use of a dispersing machine such as a homogenizer. After that, the solvent may be evaporated to produce a resin particle dispersion liquid. Alternatively, the resin particle dispersion liquid may be prepared by a method involving adding a surfactant to a resin, followed by emulsion dispersion in water with a dispersing machine such as a homogenizer, a phase inversion emulsification method, or the like.

The volume-based median diameter (D50) of the resin particles in the resin particle dispersion liquid is preferably from 0.005 μm to 1.0 μm, more preferably from 0.01 μm to 0.4 μm. When the volume-based median diameter of the resin particles satisfies the above-mentioned range, a toner having an appropriate particle diameter can be more easily obtained.

The average particle diameter of the resin particles may be measured by a measurement method such as a dynamic light scattering method (DLS), a laser scattering method, a centrifugal sedimentation method, a field-flow fractionation method, or an electrical sensing zone method. It should be noted that the average particle diameter of the resin particles in the present invention means a volume-based 50% cumulative particle diameter value (D50), which is measured by a dynamic light scattering method (DLS)/laser Doppler method at 20° C. and at a solid concentration of 0.01 mass %, unless otherwise stated.

(Colorant Dispersion Liquid)

The colorant dispersion liquid to be used in the emulsion aggregation method is prepared by dispersing a colorant in an aqueous medium together with a surfactant. A specific example of a preparation method is described below.

First, the compound represented by the general formula (1) of the present invention is prepared as a dispersion liquid (coloring matter dispersion). In addition, a dispersion liquid having mixed therein a plurality of the compounds represented by the general formula (1) may be prepared. The colorant is dispersed by a known method, and a medium-type dispersing machine such as a rotation shearing-type homogenizer, a ball mill, a sand mill, or an attritor, or a high-pressure counter collision-type dispersing machine is preferably used.

The amount of use of the surfactant to be used is preferably from 0.01 part by mass to 10 parts by mass, more preferably from 0.1 part by mass to 5.0 parts by mass, still more preferably from 0.5 part by mass to 3.0 parts by mass with respect to 100 parts by mass of the colorant from the viewpoint of easily removing the surfactant in the toner. As a result, the amount of the surfactant remaining in the resultant toner becomes small, resulting in such effects that the image density of the toner is high and fogging hardly occurs.

[Aggregation Step]

A method of forming an aggregate particle is not particularly limited and may be suitably exemplified by a method involving adding and mixing a pH adjuster, a flocculant, and a stabilizer into the above-mentioned mixed liquid and appropriately applying a temperature and mechanical power (stirring).

The pH adjuster is not particularly limited and examples thereof include alkalis such as ammonia and sodium hydroxide and acids such as nitric acid and citric acid.

The flocculant is not particularly limited and examples thereof include divalent or higher valent metal complexes as well as inorganic metal salts such as sodium chloride, magnesium carbonate, magnesium chloride, magnesium nitrate, magnesium sulfate, calcium chloride, and aluminum sulfate.

Examples of the stabilizer mainly include surfactants.

The surfactants are not particularly limited and examples thereof include: water-soluble polymers such as polyvinyl alcohol, methylcellulose, carboxymethylcellulose, and sodium polyacrylate; surfactants including anionic surfactants such as sodium dodecylbenzenesulfonate, sodium octadecylsulfate, sodium oleate, sodium laurate, and potassium stearate, cationic surfactants such as laurylamine acetate and lauryltrimethylammonium chloride, amphoteric surfactants such as lauryldimethylamine oxide, and nonionic surfactants such as a polyoxyethylene alkyl ether, a polyoxyethylene alkylphenyl ether, and a polyoxyethylene alkylamine; and inorganic compounds such as tricalcium phosphate, aluminum hydroxide, calcium sulfate, calcium carbonate, and barium carbonate. It should be noted that one kind of those stabilizers may be used alone, or two or more kinds thereof may be used in combination as necessary.

The average particle diameter of the aggregation particles to be formed in this step is not particularly limited but is generally recommended to be controlled to one similar to the average particle diameter of toner particles to be obtained. The control may be easily performed, for example, by appropriately setting and changing a temperature at the time of the addition and mixing of the flocculant and the like and conditions for the above-mentioned mixing with stirring. Further, in order to reduce fusion between the toner particles, the pH adjuster and the surfactant may be appropriately loaded.

[Fusion Step]

In a fusion step, the aggregate particle is fused by heating to form a toner particle.

A temperature for the heating only needs to fall within the range of from the glass transition temperature (Tg) of a resin contained in the aggregate particle to the decomposition temperature of the resin. Under stirring in the same manner as in the aggregation step, the progress of the aggregation is stopped by the addition of a surfactant or the adjustment of a pH, and the aggregate particle is caused to fuse and coalesce by heating to a temperature equal to or higher than the glass transition temperature of the resin in the resin particle.

A time for the heating only needs to be such a time that the fusion is sufficiently caused. Specifically, the heating only needs to be performed for from about 10 minutes to 10 hours.

In addition, a step including adding and mixing a fine particle dispersion liquid, which is obtained by dispersing a fine particle, to allow the fine particle to adhere to the aggregate particle, thereby forming a core-shell structure (adhesion step) may be further included before or after the fusion step.

[Washing Step]

The toner particle obtained after the fusion step is subjected to washing, filtration, and drying under appropriate conditions to provide a toner particle. In this case, it is preferred to sufficiently wash the toner particle in order to ensure a charging property and reliability sufficient as a toner.

A washing method is not limited, and the washing may be performed by filtering a suspension containing a toner particle, and washing the resultant filtration residue by stirring with distilled water, followed by filtration. From the viewpoint of the charging property of toner, the washing is repeated until the electrical conductivity of the filtrate reaches 150 μS/cm or less. When the electrical conductivity of the filtrate is 150 μS/cm or less, a reduction in charging property of toner is suppressed. As a result, the occurrence of fogging can be suppressed and the image density can be more improved.

[Drying Step]

Drying may be performed by a generally known method such as a vibration-type fluidized drying method, a spray dry method, a lyophilization method, or a flash jet method. The moisture content of the toner particle after the drying is preferably 1.5 mass % or less, more preferably 1.0 mass % or less.

The yellow toner of the present invention has a weight-average particle diameter (D4) of preferably from 4.0 μm to 9.0 μm, more preferably from 4.9 μm to 7.5 μm. When the weight-average particle diameter (D4) of the yellow toner satisfies the above-mentioned range, charging stability is improved, and in a continuous development operation (duration operation) on a large number of sheets, the occurrence of image fogging or a development stripe is more suppressed. In addition, the reproducibility of a halftone portion is more improved.

The yellow toner of the present invention has a ratio of the weight-average particle diameter (D4) to a number-average particle diameter (D1) (hereinafter sometimes referred to as "weight-average particle diameter (D4)/number-average particle diameter (D1)" or "D4/D1") of preferably 1.35 or less, more preferably 1.30 or less. When the yellow toner satisfies the above-mentioned relationship, the occurrence of fogging is suppressed and transferability is improved, and besides, a more uniform line width is achieved.

It should be noted that a method of adjusting the weight-average particle diameter (D4) and number-average particle diameter (D1) of the yellow toner of the present invention varies depending on the production method for a toner particle. For example, in the case of the suspension polymerization method, adjustment may be performed by controlling, for example, the concentration of a dispersant to be used in the preparation of the aqueous medium, a reaction stirring rate, or a reaction stirring time.

The yellow toner of the present invention has an average circularity as measured with a flow particle image analyzer of preferably 0.930 or more and 0.995 or less, and from the viewpoint of significant improvement in transferability of the toner, the average circularity of the yellow toner is more preferably 0.960 or more and 0.990 or less.

[Liquid Developer and Production Method Therefor]

In addition, the toner of the present invention may also be used in a developer to be used in a liquid development method (hereinafter referred to as "liquid developer").

Now, a production method for a liquid developer is described.

First, the liquid developer is produced by dispersing or dissolving a colorant containing a compound represented by the general formula (1), a binder resin, a wax, and as necessary, an aid such as a charge control agent in an electrical insulating carrier liquid. Alternatively, the liquid developer may be prepared by a double-stage method involving first preparing a concentrated toner and diluting the toner with an electrical insulating carrier liquid to prepare a developer.

A dispersing machine is not particularly limited, and a medium-type dispersing machine such as a rotation shearing-type homogenizer, a ball mill, a sand mill, or an attritor, or a high-pressure counter collision-type dispersing machine is preferably used.

As the colorant, there may be used one obtained by further adding a known colorant such as a pigment or a dyestuff alone or in combination of two or more kinds thereof to the compound represented by the general formula (1).

The wax and the binder resin are the same as described above.

The charge control agent is not particularly limited as long as it is used for a liquid developer for electrostatic charge development, and examples thereof include cobalt naphthenate, copper naphthenate, copper oleate, cobalt oleate, zirconium octylate, cobalt octylate, sodium dodecylbenzenesulfonate, calcium dodecylbenzenesulfonate, soybean lecithin, and aluminum octoate.

The electrical insulating carrier liquid to be used in the present invention is not particularly limited, and for example, an organic solvent having as high an electrical resistance as $10^9$ Ω·cm or more and as low a dielectric constant as 3 or less is preferably used.

Preferred specific examples thereof include ones having a boiling point within the temperature range of from 68° C. to 250° C., such as an aliphatic hydrocarbon solvent such as hexane, pentane, octane, nonane, decane, undecane, or dodecane, ISOPAR H, G, K, L, or M (manufactured by Exxon Mobil Corporation), and LINEALENE DIMER A-20 or A-20H (manufactured by Idemitsu Kosan Co., Ltd.). They may be used alone or in combination of two or more kinds thereof in such a range that the viscosity of a system does not become high.

EXAMPLES

Now, the present invention is described in more detail by way of Examples and Comparative Examples. However, the present invention is not limited to these Examples. It should be noted that the terms "part(s)" and "%" in the following description refer to "part(s) by mass" and "mass %" unless otherwise stated. The resultant reaction products were identified by multiple analysis methods using the following devices. That is, the following analysis devices were used: a $^1$H nuclear magnetic resonance spectrometer (ECA-400, manufactured by JEOL Ltd.) and a MALDI MS (autoflex device, manufactured by Bruker Daltonics K.K.). It should be noted that in the MALDI MS, the ions were detected in a negative mode.

Synthesis Example

Production of Compound (1)

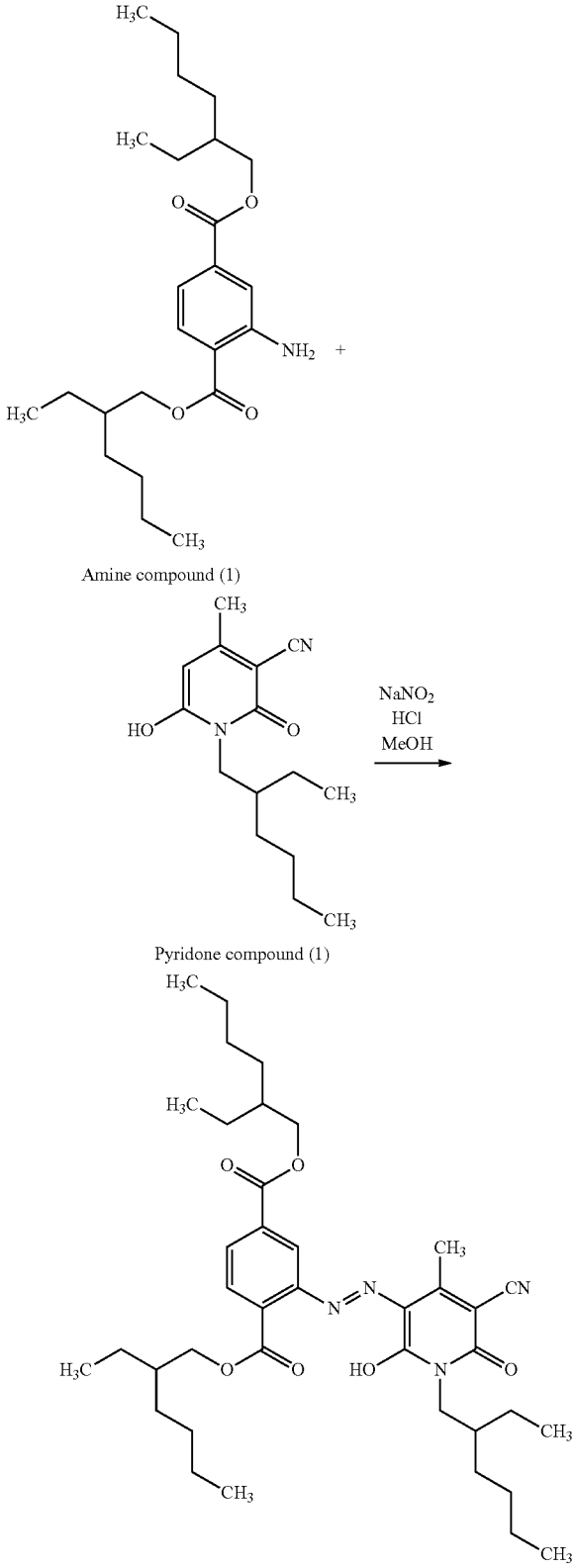

A solution of 1.6 g of an amine compound (1) in 40 mL of methanol (MeOH) was cooled to 5° C., and then 0.7 mL of 35% hydrochloric acid was added dropwise. To the mixture, a solution of 0.30 g of sodium nitrite in 3 mL of water was added dropwise (diazotization liquid A). In addition, separately, a solution of 1.04 g of a pyridone compound (1) in 20 mL of methanol (MeOH) was cooled to 5° C., and the diazotization liquid A was slowly added dropwise thereto so as to keep the temperature at 5° C. or less. The mixture was further stirred at from 0° C. to 5° C. for 3 hours. After the completion of the reaction, an aqueous solution of sodium carbonate was added dropwise to neutralize the pH to 6, and then the organic layer was extracted with chloroform. The organic layer was concentrated under reduced pressure and the resultant viscous mass was purified by column chromatography (developing solvent: heptane/ethyl acetate) to give 1.65 g of the compound (1).

[Analysis Result on Compound (1)]

[1] $^1$H-NMR (400 MHz, $CDCl_3$, room temperature, see FIG. 1): δ (ppm)=15.83 (1H, s), 8.65 (1H, s), 8.17 (1H, d), 7.91 (1H, d), 4.41-4.25 (4H, m), 3.99-3.94 (2H, m), 2.67 (3H, s), 2.19-2.16 (4H, m), 1.93-1.71 (3H, m), 1.52-1.24 (22H, m), 0.99-0.87 (16H, m).

[2] Mass spectrometry by MALDI-TOF-MS: m/z=677.317 $(M-H)^-$

The compounds (2), (14), (5), (21), (19), (22), and (28) to be used in the following Examples were synthesized in the same manner as in Synthesis Example of the compound (1) by using corresponding raw materials.

[Production of Yellow Toner]

Yellow toners of the present invention and comparative yellow toners were produced by methods described below.

Example 1

5 Parts by mass of the compound (1) and 120 parts by mass of styrene were mixed for 3 hours using an attritor (manufactured by Mitsui Mining Co., Ltd.) to provide a coloring matter dispersion (1).

A 2-L four-necked flask equipped with a high-speed stirring device T.K. homomixer (manufactured by PRIMIX Corporation) was loaded with 710 parts of ion-exchanged water and 450 parts of a 0.1 mol/L aqueous solution of trisodium phosphate. The mixture was heated to 60° C. while being stirred at a number of revolutions of 12,000 rpm. To the mixture, 68 parts by mass of a 1.0 mol/L aqueous solution of calcium chloride was gradually added to prepare an aqueous medium containing calcium phosphate as a fine and poorly water-soluble dispersion stabilizer.

| | |
|---|---|
| Coloring matter dispersion (1) | 133.2 parts by mass |
| Styrene | 46.0 parts by mass |
| n-Butyl acrylate | 34.0 parts by mass |
| Aluminum salicylate compound (manufactured by Orient Chemical Industries Co., Ltd., BONTRON E-88) | 2.0 parts by mass |
| Polar resin (Polycondensated product of propylene oxide-modified bisphenol A and isophthalic acid, Tg = 65° C., Mw = 10,000, Mn = 6, 000) | 10.0 parts by mass |
| Ester wax (Peak temperature of maximum endothermic peak in DSC measurement (melting point) = 70° C., Mn = 704) | 25.0 parts by mass |
| Divinylbenzene | 0.10 part by mass |

A mixture of the above-mentioned materials was heated to 60° C., and then homogeneously dissolved and dispersed at 5,000 rpm using a T.K. homomixer. To the resultant, 10 parts by mass of 2,2'-azobis(2,4-dimethylvaleronitrile) as a polymerization initiator was dissolved to prepare a polymerizable monomer composition.

Next, the polymerizable monomer composition was put into the aqueous medium, and granulated for 15 minutes while the number of revolutions was maintained at 12,000 rpm. After that, the high-speed stirring device was changed to a stirring device having a propeller stirring blade, and polymerization was continued at a liquid temperature of 60° C. for 5 hours. After that, the liquid temperature was increased to 80° C. and the polymerization was continued for hours. After the completion of the polymerization reaction, the residual monomer was evaporated at 80° C. under reduced pressure, and then the liquid temperature was reduced to 30° C. to provide a polymer fine particle dispersion.

Next, the polymer fine particle dispersion was transferred to a washing vessel, dilute hydrochloric acid was added to the stirred dispersion to adjust the pH to 1.5, and the mixture was stirred for 2 hours. The mixture was subjected to solid-liquid separation with a filter to provide polymer fine particles. Redispersion of the polymer fine particles into water and solid-liquid separation were repeated until compounds of phosphoric acid and calcium, including calcium phosphate, were sufficiently removed. After that, polymer fine particles finally obtained by solid-liquid separation were sufficiently dried with a dryer to provide yellow toner particles (1).

100 Parts by mass of the thus-obtained yellow toner particles (1) was subjected to dry mixing with 1.00 part by mass of hydrophobic silica fine powder that had been subjected to surface treatment with hexamethyldisilazane (number-average particle diameter of primary particles: 7 nm), 0.15 part by mass of rutile-type titanium oxide fine powder (number-average particle diameter of primary particles: 45 nm), and 0.50 part by mass of rutile-type titanium oxide fine powder (number-average particle diameter of primary particles: 200 nm) for 5 minutes through the use of a Henschel mixer (manufactured by Nippon Coke & Engineering. Co., Ltd.). Thus, a yellow toner (1) was obtained.

Examples 2 and 3

Yellow toners (2) and (3) were obtained in the same manner as in Example 1 except that in Example 1, 5 parts by mass of the compound (1) was changed to 6 parts by mass of the compound (2) (Example 2) and 7 parts by mass of the compound (14) (Example 3), respectively.

Comparative Example 1

A yellow toner (C1) was obtained in the same manner as in Example 1 except that the compound (1) was changed to the comparative compound (1) (shown as "C1" in Table 1).

The structure of the comparative compound (1) is shown below.

Comparative compound (1)

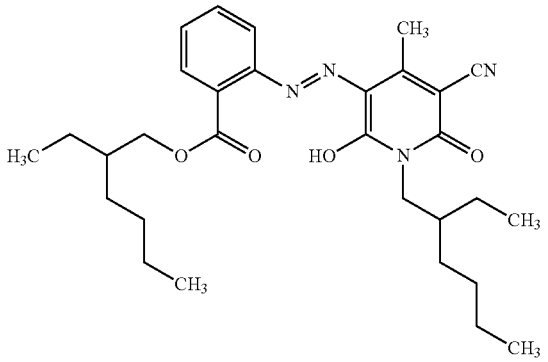

Examples 4, 5, and 6

Yellow toners (4), (5), and (6) were obtained in the same manner as in Examples 1 to 3, respectively, except that 25.0 parts by mass of the ester wax was changed to 12.5 parts by mass thereof.

Comparative Example 2

A yellow toner (C2) was obtained in the same manner as in Comparative Example 1 except that 25.0 parts by mass of the ester wax was changed to 12.5 parts by mass thereof.

Examples 7, 8, and 9

Yellow toners (7), (8), and (9) were obtained in the same manner as in Examples 1 to 3, respectively, except that 25.0 parts by mass of the ester wax was changed to 37.5 parts by mass thereof.

Comparative Example 3

A yellow toner (C3) was obtained in the same manner as in Comparative Example 1 except that 25.0 parts by mass of the ester wax was changed to 37.5 parts by mass thereof.

Example 10

| | |
|---|---|
| Styrene | 82.6 parts by mass |
| n-Butyl acrylate | 9.2 parts by mass |
| Acrylic acid | 1.3 parts by mass |
| Hexanediol diacrylate | 0.4 part by mass |
| n-Lauryl mercaptan | 3.2 parts by mass |

The above-mentioned materials were mixed. To the mixed liquid, an aqueous solution of 1.5 parts by mass of NEOGEN RK (manufactured by Dai-ichi Kogyo Seiyaku Co., Ltd.) in 150 parts by mass of ion-exchanged water was added so that the above-mentioned monomer composition was dispersed in the ion-exchanged water. Then, an aqueous solution of 0.15 part by mass of potassium persulfate in 10 parts by mass of ion-exchanged water was added while the dispersion liquid was slowly stirred for 10 minutes. After purging with nitrogen, the mixture was subjected to emulsion polymerization at 70° C. for 6 hours. After the completion of the polymerization, the reaction liquid was cooled to room temperature. Ion-exchanged water was added to the cooled reaction liquid to provide a resin particle dispersion liquid having a solid concentration of 12.5 mass % and a volume-based median diameter (D50) of 0.2 μm.

100 Parts by mass of an ester wax (peak temperature of the maximum endothermic peak in DSC measurement (melting point)=70° C., Mn=704) and 15 parts by mass of NEOGEN RK were mixed into 385 parts by mass of ion-exchanged water and dispersed with a wet jet mill JN100 (manufactured by Jokoh Co., Ltd.) for about 1 hour to provide a wax dispersion liquid. The concentration of the wax dispersion liquid was 20 mass %.

100 Parts by mass of the compound (1) and 15 parts by mass of NEOGEN RK were mixed into 885 parts by mass of ion-exchanged water and dispersed with a wet jet mill JN100 (manufactured by Jokoh Co., Ltd.) for about 1 hour to provide a compound (1) dispersion liquid.

The volume-based median diameter of colorant particles in the compound (1) dispersion liquid was 0.2 μm and the concentration of the compound (1) dispersion liquid was 10 mass %.

160 Parts by mass of the resin particle dispersion liquid, 10 parts by mass of the wax dispersion liquid, 10 parts by mass of the compound (1) dispersion liquid, and 0.2 part of magnesium sulfate were dispersed with a homogenizer (manufactured by IKA: ULTRA-TURRAX T50) and then heated to 65° C. with stirring. After stirring at 65° C. for 1 hour, the resultant was observed with a light microscope. As a result, it was found that aggregate particles having an average particle diameter of about 6.0 μm were formed. 2.2 Parts by mass of NEOGEN RK (manufactured by Dai-ichi Kogyo Seiyaku Co., Ltd.) were added and then the mixture was heated to 80° C. and stirred for 120 minutes to provide fused spherical particles. After cooling, the resultant was filtered. The particles separated by the filtration were washed by stirring with 720 parts by mass of ion-exchanged water for 60 minutes. After the washing, the particles were separated by filtration. This washing and separation-by-filtration step was repeated until the electrical conductivity of the filtrate became 150 μS/cm or less. Particles finally separated by filtration were dried using a vacuum dryer to provide yellow toner particles (10).

100 Parts by mass of the yellow toner particles (10) was subjected to dry mixing with 1.8 parts by mass of hydrophobized silica fine powder having a specific surface area measured by a BET method of 200 $m^2/g$ through the use of a Henschel mixer (manufactured by Mitsui Mining Co., Ltd.). Thus, a yellow toner (10) was obtained.

Examples 11 and 12

Yellow toners (11) and (12) were obtained in the same manner as in Example 10 except that 100 parts by mass of the compound (1) was changed to 60 parts by mass of the compound (5) (Example 11) and 55 parts by mass of the compound (21) (Example 12), respectively.

Comparative Example 4

A yellow toner (C4) was obtained in the same manner as in Example 10 except that the compound (1) was changed to the comparative compound (1).

Example 13

| | |
|---|---|
| Binder resin (polyester resin) (Tg = 55° C., acid value: 20 mg KOH/g, hydroxyl value: 16 mg KOH/g, molecular weight: Mp = 4,500, Mn = 2,300, Mw = 38,000) | 100 parts by mass |
| Compound (19) | 5 parts by mass |
| Aluminum 1,4-di-t-butylsalicylate compound | 0.5 part by mass |
| Paraffin wax (Peak temperature of maximum endothermic peak in DSC measurement (melting point): 78° C.) | 5 parts by mass |

The above-mentioned materials were mixed well with a Henschel mixer (FM-75J type, manufactured by Mitsui Mining Co., Ltd.) and then kneaded with a twin-screw kneading machine (PCM-45 type, manufactured by Ikegai Corp) set to a temperature of 130° C. at a feed amount of 60 kg/hr (the kneaded product at the time of ejection had a temperature of about 150° C.). The resultant kneaded product was cooled, roughly pulverized with a hammer mill, and then finely pulverized with a mechanical pulverizing machine (T-250: manufactured by Turbo Kogyo Co., Ltd.) at a feed amount of 20 kg/hr.

The resultant toner finely pulverized product was further classified with a multi-division classifying machine utilizing the Coanda effect to provide yellow toner particles (13).

100 Parts by mass of the yellow toner particles (13) was subjected to dry mixing with 1.8 parts by mass of hydrophobized silica fine powder having a specific surface area measured by a BET method of 200 $m^2/g$ through the use of a Henschel mixer (manufactured by Mitsui Mining Co., Ltd.). Thus, a yellow toner (13) was obtained.

Examples 14 and 15

Yellow toners (14) and (15) were obtained in the same manner as in Example 13 except that 5 parts by mass of the compound (19) was changed to 5 parts by mass of the compound (22) (Example 14) and 5 parts by mass of the compound (28) (Example 15), respectively.

Comparative Example 5

A yellow toner (C5) was obtained in the same manner as in Example 13 except that the compound (19) was changed to the comparative compound (1).

Example 16

A yellow toner (16) was obtained in the same manner as in Example 1 except that 5 parts by mass of the compound (1) was changed to 4 parts by mass of C.I. Pigment Yellow 185 (manufactured by BASF, trade name: "PALIOTOL Yellow D1155") and 3 parts by mass of the compound (1).

Example 17

100 Parts by mass of C.I. Pigment Yellow 180 (manufactured by DIC Corporation, trade name: "SYMULER Fast Yellow BY2000GT"), 15 parts by mass of NEOGEN RK, and 885 parts by mass of ion-exchanged water were mixed, and the mixture was dispersed using a wet-type jet mill JN100 (manufactured by Jokoh Co., Ltd.) for about 1 hour to provide a C.I. Pigment Yellow 180 dispersion liquid.

Colorant particles in the C.I. Pigment Yellow 180 dispersion liquid had a volume-based median diameter of 0.2 μm, and the C.I. Pigment Yellow 180 dispersion liquid had a concentration of 10 mass %.

| | |
|---|---|
| Resin particle dispersion liquid used in Example 10 | 160 parts by mass |
| Wax dispersion liquid used in Example 10 | 10 parts by mass |
| C.I. Pigment Yellow 180 dispersion liquid | 3 parts by mass |
| Compound (1) dispersion liquid used in Example 10 | 4 parts by mass |
| Magnesium sulfate | 0.2 part |

The above-mentioned materials were dispersed with a homogenizer (manufactured by IKA: ULTRA-TURRAX T50) and then heated to 65° C. with stirring. After stirring at 65° C. for 1 hour, the resultant was observed with a light microscope. As a result, it was found that aggregate particles having an average particle diameter of about 6.0 μm were formed. 2.2 Parts by mass of NEOGEN RK (manufactured by Dai-ichi Kogyo Seiyaku Co., Ltd.) was added and then the mixture was heated to 80° C. and stirred for 120 minutes to provide fused spherical particles. After cooling, the resultant was filtered. The particles separated by the filtration was washed by stirring with 720 parts by mass of ion-exchanged water for 60 minutes. After the washing, the solution containing the particles was separated by filtration. This washing and separation-by-filtration step was repeated until the electrical conductivity of the filtrate became 150 μS/cm or less. Particles finally separated by filtration were dried using a vacuum dryer to provide yellow toner particles (17).

100 Parts by mass of the yellow toner particles (17) was subjected to dry mixing with 1.8 parts by mass of hydrophobized silica fine powder having a specific surface area measured by a BET method of 200 $m^2/g$ through the use of a Henschel mixer (manufactured by Mitsui Mining Co., Ltd.). Thus, a yellow toner (17) was obtained.

Example 18

| | |
|---|---|
| Binder resin (polyester resin) (Tg = 55° C., acid value: 20 mg KOH/g, hydroxyl value: 16 mg KOH/g, molecular weight: Mp = 4,500, Mn = 2,300, Mw = 38,000) | 100 parts by mass |
| C.I. Pigment Yellow 155 (manufactured by Clariant Co., Ltd., trade name: "Toner Yellow 3GP") | 3 parts by mass |
| Compound (22) | 3 parts by mass |
| Aluminum 1,4-di-t-butylsalicylate compound | 0.5 part by mass |
| Paraffin wax (Peak temperature of maximum endothermic peak in DSC measurement (melting point): 78° C.) | 5 parts by mass |

The above-mentioned materials were mixed well with a Henschel mixer (FM-75J type, manufactured by Mitsui Mining Co., Ltd.) and then kneaded with a twin-screw kneading machine (PCM-45 type, manufactured by Ikegai Corp) set to a temperature of 130° C. at a feed amount of 60 kg/hr (the kneaded product at the time of ejection had a temperature of about 150° C.). The resultant kneaded product was cooled, roughly pulverized with a hammer mill, and then finely pulverized with a mechanical pulverizing machine (T-250: manufactured by Turbo Kogyo Co., Ltd.) at a feed amount of 20 kg/hr.

The resultant toner finely pulverized product was further classified with a multi-division classifying machine utilizing the Coanda effect to provide toner particles.

100 Parts by mass of the toner particles was subjected to dry mixing with 1.8 parts by mass of hydrophobized silica fine powder having a specific surface area measured by a BET method of 200 $m^2/g$ through the use of a Henschel mixer (manufactured by Mitsui Mining Co., Ltd.). Thus, a yellow toner (18) was obtained.

(1) Measurement of Yellow Toner for Weight-average Particle Diameter (D4) and Number-Average Particle Diameter (D1)

The number-average particle diameter (D1) and weight-average particle diameter (D4) of the above-mentioned yellow toner were measured by particle size distribution analysis based on a Coulter method. Coulter Counter TA-II or Coulter Multisizer II (manufactured by Beckman Coulter, Inc.) was used as a measurement device, and the measurement was performed according to the instruction manual of the device. As an electrolytic solution, first grade sodium chloride was used to prepare an aqueous solution containing about 1% of sodium chloride. For example, ISOTON-II (manufactured by Coulter Scientific Japan) may be used. As a specific measurement method, to 100 mL to 150 mL of the electrolytic aqueous solution, 0.1 mL to 5 mL of a surfactant (preferably an alkylbenzene sulfonate) is added as a dispersant and 2 mg to 20 mg of a measurement sample (toner) is further added. The electrolytic solution in which the sample is suspended is subjected to dispersion treatment with an ultrasonic disperser for from about 1 minute to 3 minutes. The resultant dispersion-treated liquid is measured for its volume and number of toner particles having a diameter of 2.00 μm or more with the measurement device equipped with a 100-μm aperture as an aperture, to thereby determine the volume distribution and number distribution of the toner. Then, the number-average particle diameter (D1) was calculated from the number distribution, and the weight-average particle number (D4) was calculated from the volume distribution. Based on the diameters, a ratio D4/D1 was determined (median for each channel was defined as a representative value for each channel).

Used as the channels are the following thirteen channels: 2.00 μm to 2.52 μm, 2.52 μm to 3.17 μm, 3.17 μm to 4.00 μm, 4.00 μm to 5.04 μm, 5.04 μm to 6.35 μm, 6.35 μm to 8.00 μm, 8.00 μm to 10.08 μm, 10.08 μm to 12.70 μm, 12.70 μm to 16.00 μm, 16.00 μm to 20.20 μm, 20.20 μm to 25.40 μm, 25.40 μm to 32.00 μm, and 32.00 μm to 40.30 μm.

The particle size distributions of the obtained toners are shown in Table 1. In Table 1, PY185, PY180, and PY155 refer to C.I. Pigment Yellow 185, C.I. Pigment Yellow 180, and C.I. Pigment Yellow 155, respectively.

TABLE 1

| Toner No. | Compound No. | Production method | D4 | D4/D1 |
|---|---|---|---|---|
| 1 | 1 | Suspension polymerization method | 6.33 | 1.29 |
| 2 | 2 | Suspension polymerization method | 5.98 | 1.19 |
| 3 | 14 | Suspension polymerization method | 5.67 | 1.26 |
| 4 | 1 | Suspension polymerization method | 6.22 | 1.28 |
| 5 | 2 | Suspension polymerization method | 6.02 | 1.20 |
| 6 | 14 | Suspension polymerization method | 6.05 | 1.27 |
| 7 | 1 | Suspension polymerization method | 5.78 | 1.28 |
| 8 | 2 | Suspension polymerization method | 6.15 | 1.21 |
| 9 | 14 | Suspension polymerization method | 6.25 | 1.28 |
| 10 | 1 | Emulsion aggregation method | 6.21 | 1.22 |
| 11 | 5 | Emulsion aggregation method | 6.76 | 1.21 |
| 12 | 21 | Emulsion aggregation method | 6.11 | 1.22 |
| 13 | 19 | Pulverization method | 5.13 | 1.14 |
| 14 | 22 | Pulverization method | 5.12 | 1.15 |
| 15 | 28 | Pulverization method | 5.22 | 1.14 |
| 16 | PY185/1 | Suspension polymerization method | 5.78 | 1.30 |
| 17 | PY180/1 | Emulsion aggregation method | 6.27 | 1.21 |
| 18 | PY155/22 | Pulverization method | 6.05 | 1.26 |
| C1 | C1 | Suspension polymerization method | 7.42 | 1.29 |
| C2 | C1 | Suspension polymerization method | 6.99 | 1.27 |
| C3 | C1 | Suspension polymerization method | 6.75 | 1.22 |
| C4 | C1 | Emulsion aggregation method | 6.21 | 1.21 |
| C5 | C1 | Pulverization method | 6.94 | 1.33 |

(2) Evaluation of Image Sample Using Yellow Toner

Next, image samples were output with the yellow toners (1) to (18) and (C1) to (C5), and compared and evaluated for their image properties to be described later. It should be noted that, in the comparison of image properties, paper-feeding endurance using a remodeled machine of LBP-5300 (manufactured by Canon Inc.) as an image-forming apparatus was performed. The remodeling was performed as follows: a developing blade in a process cartridge (hereinafter referred to as "CRG") was exchanged to an SUS blade having a thickness of 8 μm; and the application of a blade bias of −200 V with respect to a developing bias to be applied to a developing roller as a toner bearing member was made possible.

In the evaluation, a CRG loaded with each individual yellow toner was prepared for each evaluation item. Then, the CRG loaded with each toner was separately set in the image forming apparatus, and evaluation was performed for each evaluation item described below.

First, the image sample of each of the yellow toners (1) to (18) and (C1) to (C5) was measured for its chromaticity (L*, a*, b*) in the L*a*b* color system with a reflection densitometer SpectroLino (manufactured by Gretag Macbeth).

<Evaluation of Optical Density (OD) of Toner>

Under a normal environment (temperature: 25° C./humidity: 60% RH), a 16-step gradation image sample having its maximum toner laid-on level adjusted to 0.45 mg/cm$^2$ was produced using a modified machine of a color copying machine CLC-1100 (manufactured by Canon Inc., a fixing oil-applying mechanism was removed). In the production of the image sample, CLC color copy paper (manufactured by Canon Inc.) was used as base paper for the image sample. The resultant image sample was analyzed with SpectroLino (manufactured by Gretag Machbeth). Based on the analysis results, evaluation was performed with a yellow optical density OD(Y) corresponding to the maximum toner laid-on level in the gradation. It should be noted that as the dispersion state of the colorant becomes more satisfactory, the optical density of the toner is increased.

A: OD(Y) is 1.6 or more (the optical density is extremely high).

B: OD(Y) is 1.5 or more and less than 1.6 (the optical density is high).

C: OD(Y) is less than 1.5 (the optical density is low).

<Evaluation of Light Fastness of Toner>

The image sample obtained in the chromaticity measurement was put into a xenon test apparatus (Atlas Ci4000, manufactured by Suga Test Instruments Co., Ltd.) and exposed for 50 hours under the conditions of an irradiance of 0.39 W/m$^2$ at 340 nm, a temperature of 40° C., and a relative humidity of 60%. The reflection density of the printed article was measured before and after the test. When the initial chromaticity values were represented by $a_0$*, $b_0$*, and $L_0$*, respectively, and the chromaticity values after the exposure were represented by a*, b*, and L*, respectively, a color difference ΔE was defined as follows and calculated.

$$\Delta E=\sqrt{(a^*-a^*_0)^2+(b^*-b^*_0)^2+(L^*-L^*_0)^2}$$

Evaluation criteria are as described below.

A: ΔE<3.0

B: 3.0≤ΔE<5.0

C: 5.0≤ΔE

TABLE 2

| | Toner No. | OD | OD evaluation | ΔE after 50 hours | Light fastness evaluation |
|---|---|---|---|---|---|
| Example 1 | 1 | 1.63 | A | 2.6 | A |
| Example 2 | 2 | 1.65 | A | 3.1 | B |
| Example 3 | 3 | 1.61 | A | 2.3 | A |
| Example 4 | 4 | 1.64 | A | 2.6 | A |
| Example 5 | 5 | 1.65 | A | 3.1 | B |
| Example 6 | 6 | 1.62 | A | 2.3 | A |
| Example 7 | 7 | 1.61 | A | 2.6 | A |
| Example 8 | 8 | 1.64 | A | 3.1 | B |
| Example 9 | 9 | 1.60 | A | 2.3 | A |
| Example 10 | 10 | 1.60 | A | 4.9 | B |
| Example 11 | 11 | 1.62 | A | 4.8 | B |
| Example 12 | 12 | 1.61 | A | 2.9 | A |
| Example 13 | 13 | 1.64 | A | 2.8 | A |
| Example 14 | 14 | 1.66 | A | 2.9 | A |
| Example 15 | 15 | 1.63 | A | 4.6 | B |
| Example 16 | 16 | 1.59 | B | 1.5 | A |
| Example 17 | 17 | 1.55 | B | 2.0 | A |
| Example 18 | 18 | 1.58 | B | 1.3 | A |
| Comparative Example 1 | C1 | 1.46 | C | 8.4 | C |
| Comparative Example 2 | C2 | 1.49 | C | 8.4 | C |
| Comparative Example 3 | C3 | 1.36 | C | 8.4 | C |
| Comparative Example 4 | C4 | 1.42 | C | 9.7 | C |
| Comparative Example 5 | C5 | 1.41 | C | 7.3 | C |

As apparent from Table 2, the toners produced using the coloring matter compound (colorant) represented by the general formula (1) are each found to have high coloring power and be excellent in light fastness as compared to the toners produced using the comparative compound. In addition, it was also found that the coloring power was not influenced by the amount of the wax.

The toner according to the present invention can be used as a toner having high coloring power and high light fastness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-060338, filed Mar. 24, 2014, which is hereby incorporated by reference herein in its entirety.

What is claimed is:

1. A yellow toner, comprising:

a binder resin;

a wax; and a colorant containing a compound represented by formula (1):

(1)

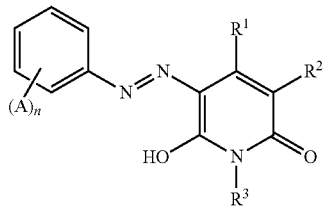

wherein $R^1$ represents an alkyl group, an aryl group, or an amino group;

$R^2$ represents a hydrogen atom, a cyano group, a carbamoyl group, an alkoxycarbonyl group, or a carboxamide group;

$R^3$ represents a hydrogen atom, an alkyl group, or an acyl group;

A independently represents an alkoxysulfonyl group, a carboxamide group, or a sulfonamide group; and n represents an integer of from 2 to 5.

2. A yellow toner according to claim 1, wherein in formula (1), $R^1$ represents an alkyl group or an aryl group, $R^2$ represents a cyano group or an alkoxycarbonyl group, $R^3$ represents a hydrogen atom or an alkyl group, and A represents a carboxamide group.

3. A yellow toner according to claim 1, wherein in formula (1), $R^1$ represents an alkyl group, $R^2$ represents a cyano group, $R^3$ represents an alkyl group, and A represents a carboxy di(2-ethylhexyl)amide group.

4. A production method for a yellow toner, comprising the steps of:

preparing a polymerizable monomer composition containing a colorant, a wax, and a polymerizable monomer;

forming a particle of the polymerizable monomer composition in an aqueous medium; and polymerizing the polymerizable monomer, which is contained in the particle of the polymerizable monomer composition, in the aqueous medium to provide a toner particle, wherein the colorant contains a compound represented by formula (1):

(1)

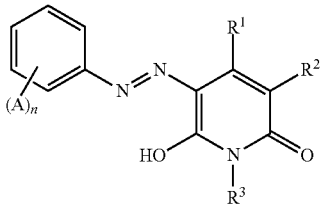

in which $R^1$ represents an alkyl group, an aryl group, or an amino group;

$R^2$ represents a hydrogen atom, a cyano group, a carbamoyl group, an alkoxycarbonyl group, or a carboxamide group;

$R^3$ represents a hydrogen atom, an alkyl group, or an acyl group;

A independently represents an alkoxysulfonyl group, a carboxamide group, or a sulfonamide group; and n represents an integer of from 2 to 5.

5. A production method for a yellow toner, comprising the steps of:

preparing a wax dispersion liquid having a wax dispersed in an aqueous medium;

preparing a resin particle dispersion liquid having a resin particle dispersed in an aqueous medium;

preparing a colorant dispersion liquid having a colorant dispersed in an aqueous medium;

aggregating the wax, the resin particle, and the colorant, which are contained in the wax dispersion liquid, the resin particle dispersion liquid, and the colorant dispersion liquid, respectively, by mixing the dispersion liquids with each other, to thereby form an aggregated particle; and fusing the aggregated particle through heating, wherein the colorant contains a compound represented by formula (1):

(1)

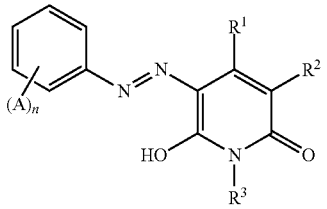

in which $R^1$ represents an alkyl group, an aryl group, or an amino group;

$R^2$ represents a hydrogen atom, a cyano group, a carbamoyl group, an alkoxycarbonyl group, or a carboxamide group;

$R^3$ represents a hydrogen atom, an alkyl group, or an acyl group;

A independently represents an alkoxysulfonyl group, a carboxamide group, or a sulfonamide group; and n represents an integer of from 2 to 5.

* * * * *